US008166732B2

(12) United States Patent
Cousins et al.

(10) Patent No.: US 8,166,732 B2
(45) Date of Patent: May 1, 2012

(54) STRETCH WRAP MACHINE WITH TOP CORNER FILM TRANSFER

(75) Inventors: Neil G. Cousins, Tottenham (CA); Boris Radovanovic, Mississauga (CA)

(73) Assignee: Cousins Packaging Inc., Etobicoke, Ontario (CA)

( * ) Notice: Subject to any disclaimer, the term of this patent is extended or adjusted under 35 U.S.C. 154(b) by 0 days.

(21) Appl. No.: 12/793,012

(22) Filed: Jun. 3, 2010
(Under 37 CFR 1.47)

(65) Prior Publication Data

US 2010/0236192 A1 Sep. 23, 2010

Related U.S. Application Data

(63) Continuation of application No. 11/744,012, filed on May 3, 2007, now Pat. No. 7,775,016, and a continuation-in-part of application No. PCT/IB2005/004121, filed on Nov. 3, 2005.

(60) Provisional application No. 60/821,162, filed on Aug. 2, 2006, provisional application No. 60/624,703, filed on Nov. 3, 2004.

(51) Int. Cl.
*B65B 11/28* (2006.01)

(52) U.S. Cl. ..... 53/441; 53/211; 53/556; 53/587

(58) Field of Classification Search ..... 53/399, 53/441, 556, 587, 588, 589, 211, 218
See application file for complete search history.

(56) References Cited

U.S. PATENT DOCUMENTS

| | | | | | |
|---|---|---|---|---|---|
| 3,640,048 | A | * | 2/1972 | Zelnick et al. | 53/442 |
| 3,707,064 | A | | 12/1972 | Mucka et al. | |
| 3,867,806 | A | | 2/1975 | Lancaster, III et al. | |
| 3,965,652 | A | | 6/1976 | Cimins | |
| 4,063,401 | A | * | 12/1977 | Higgins | 53/567 |
| 4,077,179 | A | | 3/1978 | Lancaster et al. | |
| 4,079,565 | A | * | 3/1978 | Lancaster et al. | 53/397 |
| 4,109,445 | A | * | 8/1978 | Shulman | 53/588 |
| 4,152,879 | A | | 5/1979 | Shulman | |
| 4,283,903 | A | | 8/1981 | Mayhall et al. | |
| 4,300,326 | A | | 11/1981 | Stackhouse | |
| 4,409,776 | A | * | 10/1983 | Usui | 53/399 |
| 4,413,463 | A | | 11/1983 | Lancaster | |
| 4,432,185 | A | | 2/1984 | Geisinger | |

(Continued)

FOREIGN PATENT DOCUMENTS

DE 3236029 12/1983

(Continued)

OTHER PUBLICATIONS

Machine translation for DE 32 36 029, obtained Mar. 28, 2011.*

(Continued)

*Primary Examiner* — Paul Durand
(74) *Attorney, Agent, or Firm* — Flynn, Thiel, Boutell & Tanis, P.C.

(57) ABSTRACT

A stretch wrap machine for wrapping a product comprising a base, a turn table on the base for rotating the product, a source of stretch wrap connected to the base, and a wrapping assembly configured to bring an end of the stretch wrap above the product, cut the stretch wrap at a position above the product after the product has been wrapped and/or hold an end of the stretch wrap at a position above the product as the turntable begins rotating the product.

9 Claims, 41 Drawing Sheets

U.S. PATENT DOCUMENTS

| | | | | | |
|---|---|---|---|---|---|
| 4,450,668 | A | | 5/1984 | Grossi | |
| 4,779,396 | A | | 10/1988 | Stackhouse | |
| 4,807,427 | A | | 2/1989 | Casteel et al. | |
| 4,845,920 | A | | 7/1989 | Lancaster | |
| 4,905,448 | A | * | 3/1990 | Plitt | 53/399 |
| 4,934,123 | A | | 6/1990 | Salzsauler | |
| 4,936,080 | A | * | 6/1990 | Haloila | 53/465 |
| 4,991,381 | A | | 2/1991 | Simons | |
| 4,993,209 | A | * | 2/1991 | Haloila | 53/399 |
| 5,020,300 | A | | 6/1991 | Casteel | |
| 5,048,261 | A | * | 9/1991 | Lancaster et al. | 53/399 |
| 5,107,657 | A | | 4/1992 | Diehl et al. | |
| 5,195,301 | A | * | 3/1993 | Martin-Cocher et al. | 53/441 |
| 5,216,871 | A | * | 6/1993 | Hannen | 53/556 |
| 5,447,008 | A | | 9/1995 | Martin-Cocher | |
| 5,450,711 | A | * | 9/1995 | Martin-Cocher | 53/556 |
| 5,452,566 | A | * | 9/1995 | Benhamou et al. | 53/556 |
| 5,463,842 | A | | 11/1995 | Lancaster | |
| 5,720,153 | A | | 2/1998 | Martin-Cocher | |
| 5,765,344 | A | | 6/1998 | Mandeville et al. | |
| 5,794,418 | A | | 8/1998 | Lai | |
| 5,878,555 | A | | 3/1999 | Turfan et al. | |
| 5,893,258 | A | | 4/1999 | Lancaster, III | |
| 5,911,666 | A | | 6/1999 | Lancaster, III et al. | |
| 6,065,269 | A | | 5/2000 | Malnati | |
| 6,164,047 | A | | 12/2000 | Rossi | |
| RE37,237 | E | | 6/2001 | Lancaster, III et al. | |
| 6,269,610 | B1 | | 8/2001 | Lancaster, III et al. | |
| 6,293,074 | B1 | | 9/2001 | Lancaster, III et al. | |
| 6,453,643 | B1 | | 9/2002 | Buscherini et al. | |
| 6,516,591 | B1 | | 2/2003 | Lancaster, III et al. | |
| 6,550,222 | B2 | | 4/2003 | DeGrasse | |
| 6,775,956 | B1 | | 8/2004 | Lacey | |

FOREIGN PATENT DOCUMENTS

| | | |
|---|---|---|
| EP | 0022135 | 1/1981 |
| EP | 0180517 | 5/1986 |

OTHER PUBLICATIONS

Machine translation for EP 0022135, obtained Mar. 28, 2011.*

* cited by examiner

STRETCH WRAP MACHINE WITH TOP CORNER FILM TRANSFER

CROSS-REFERENCE TO RELATED APPLICATIONS

This application is a continuation of U.S. patent application Ser. No. 11/744,012 entitled STRETCH WRAP MACHINE WITH TOP CORNER FILM TRANSFER, which was filed on May 3, 2007, now U.S. Pat. No. 7,775,016, which claimed priority to U.S. Provisional Patent Application No. 60/821,162, entitled STRETCH WRAP MACHINE WITH OVERHEAD GRIPPING PLATES, which was filed on Aug. 2, 2006 and was a continuation-in-part of PCT Application No. PCT/IB2005/004121, entitled STRETCH WRAP MACHINE WITH TOP CORNER FILM TRANSFER, which was filed on Nov. 3, 2005, which claimed priority to U.S. Provisional Patent Application No. 60/624,703, entitled STRETCH WRAP MACHINE WITH TOP CORNER FILM TRANSFER, which was filed on Nov. 3, 2004.

FIELD OF THE INVENTION

The present invention concerns stretch wrap machines, and more particularly relates to stretch wrap machines with a top corner film transfer.

BACKGROUND

Wrapping machines have been developed for wrapping plastic film around items on a pallet to retain the items for shipping and the like. Known wrapping machines include a film dispenser mounted on an arm to rotate about the pallet and thereby wrap the items on the pallet. The film dispenser may also be mounted for vertical travel such that the film is wrapped around the items in a spiral manner. Other known wrapping machines include a rotary table upon which the pallet is placed. In this type of machine, the wrapping device is mounted to a stationary vertical structure. During the wrapping process, the table and pallet thereon are rotated, and the wrapping device travels vertically to thereby spiral wrap the items on the pallet.

Heretofore, wrapping machines have include a gripper that grips the end of the film to thereby hold the film in a proper position as it is fed from the film dispenser. Known grippers maintain the end of the film adjacent a side of the pallet and an end of the film typically has to be blown or wiped against the side of the product on the pallet at the end of the wrapping process. During the wrapping process, the gripper remains outside of the external vertical periphery of the pallet.

A wrapping machine is desired making improvements on the aforementioned known wrapping machines.

SUMMARY OF THE PRESENT INVENTION

An aspect of the present invention is to provide a wrapping machine for wrapping a product comprising a base, a turntable on the base for rotating the product, a source of wrapping material connected to the base, the source of wrapping material supplying wrapping material to the product and an apparatus configured to cut the wrapping material at a position above the product during wrapping of the product or after the product has been wrapped.

Another aspect of the present invention is to provide a wrapping machine for wrapping a product comprising a base, a turntable on the base for rotating the product about a first vertical axis, a source of wrapping material connected to the base, the source of wrapping material supplying wrapping material to the product, the source of wrapping material having a second vertical axis of rotation and an apparatus configured to hold a portion of the wrapping material at a position above the product as the turntable begins rotating the product.

Yet another aspect of the present invention is to provide a method of wrapping a product with wrapping material comprising holding a source of the wrapping material in a horizontally stationary position, rotating the product about a vertical axis to wrap the product with the wrapping material and positioning a leading end of the wrapping material above a top height of the product.

A further aspect of the present invention is to provide a method of wrapping a product with wrapping material comprising rotating the product and dropping an end of the wrapping material on top of the product during or after rotation.

Another aspect of the present invention is to provide a method of wrapping a product with wrapping material comprising rotating the product relative to a source of the wrapping material, wrapping the product with the wrapping material and not maintaining a leading end of the wrapping material stationary relative to the product during initiation of a rotation cycle of the product relative to the source of the wrapping material.

Yet another aspect of the present invention is to provide a method of wrapping a product with wrapping material comprising rotating the product relative to a source of the wrapping material, wrapping the product with the wrapping material and not maintaining a leading end of the wrapping material stationary relative to the product during initiation of a rotation cycle of the product relative to the source of the wrapping material.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
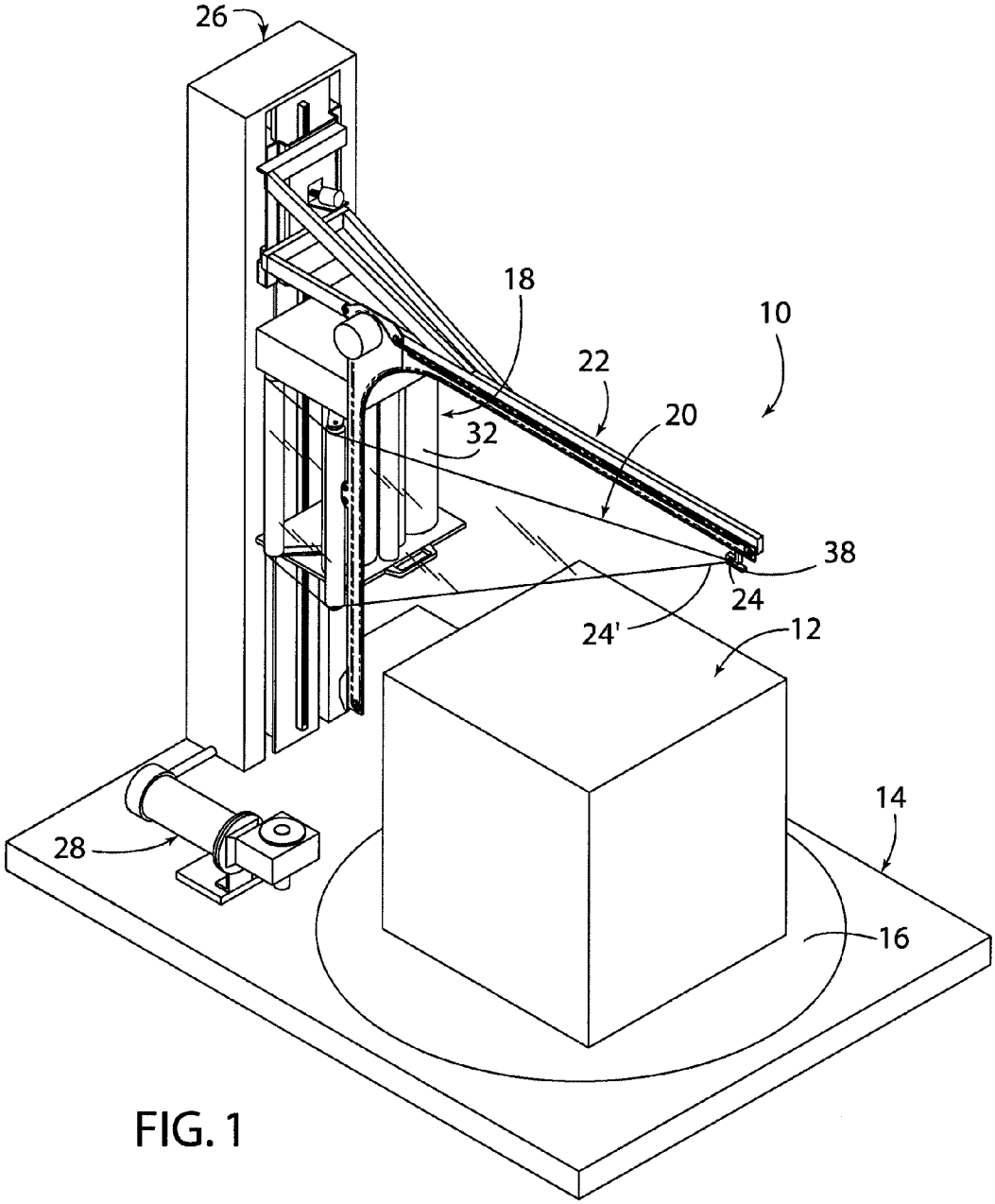
FIG. 1 is a perspective view of a stretch wrap machine of the present invention in an initial position.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1-5D) generally designates a stretch wrap machine embodying the present invention. In the illustrated example, the stretch wrap machine 10 is for wrapping a product 12 and comprises a base 14, a turntable 16 on the base 14 for rotating the product 12, a source 18 of stretch wrap 20 connected to the base 14 and a wrapping assembly 22. The wrapping assembly 22 is configured to bring a portion 24 of the stretch wrap 20 above the product 12, cut the stretch wrap 20 at a position above the product 12 after the product 12 has been wrapped and/or hold the portion 24 of the stretch wrap 20 at a position above the product 12 as the turntable 16 begins rotating the product 12.

Figure 2:
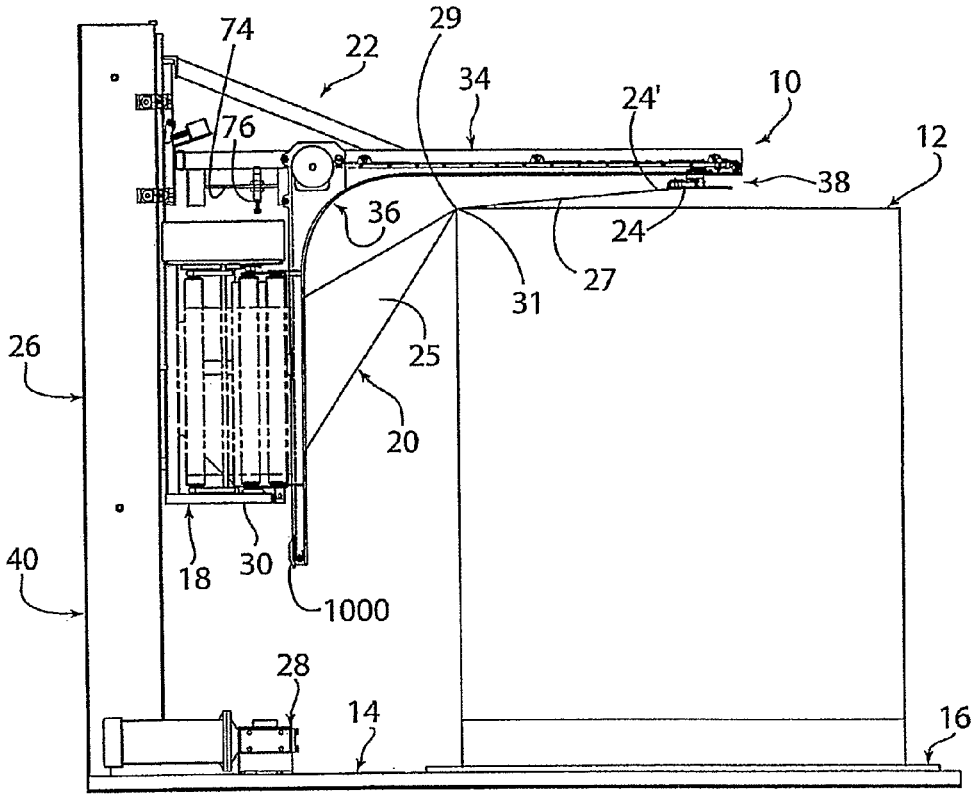
FIG. 2 is a front view of the stretch wrap machine of the present invention in a start position and with a cover of a column and carriage removed to show details of the machine.
Figure 3:
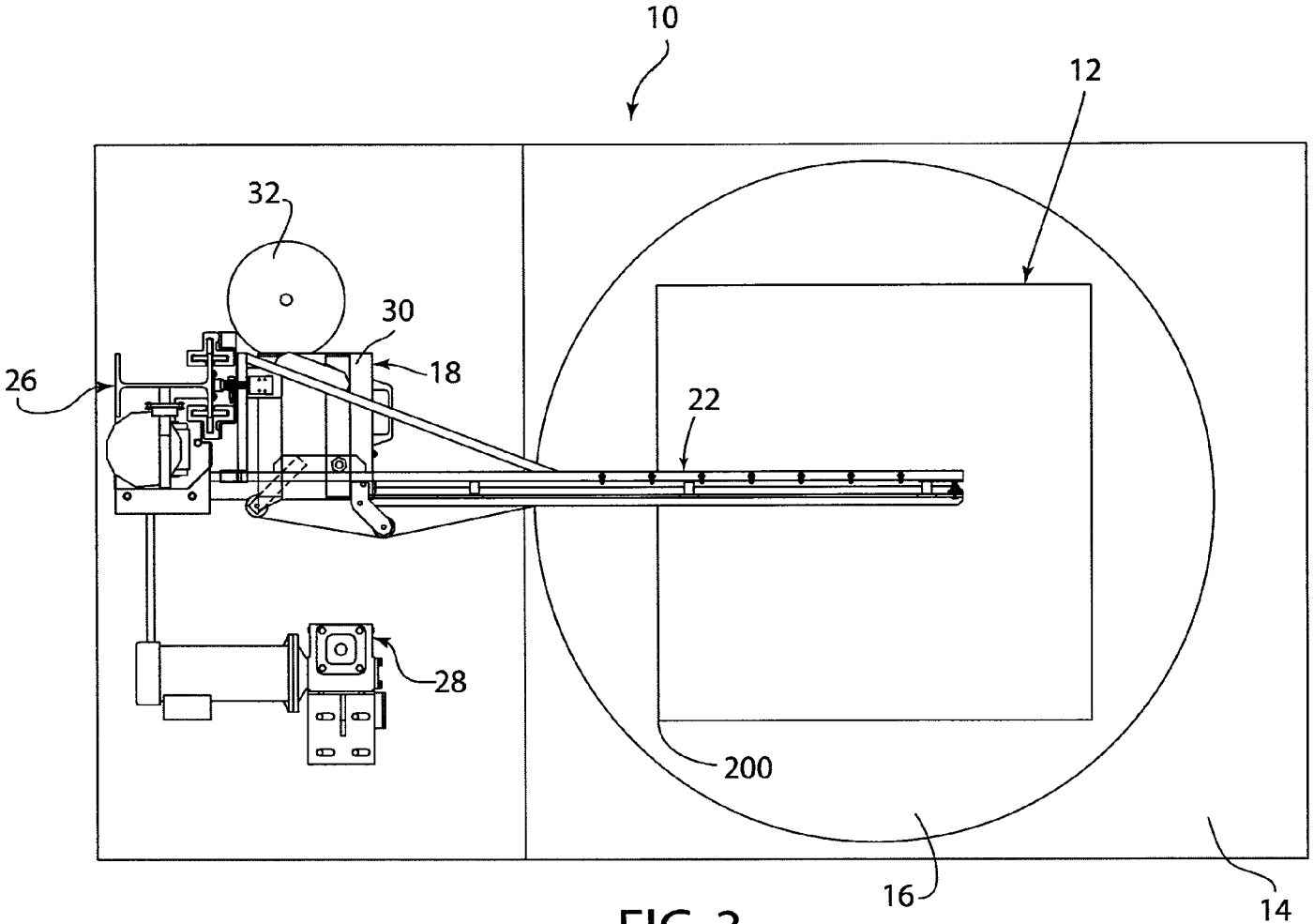
FIG. 3 is top view of the stretch wrap machine of the present invention in the start position and with the cover of the column and carriage removed to show details of the machine.

FIG. 1 illustrates the stretch wrap machine 10 in an initial position. In the initial position, a product 12 that has not been wrapped yet is placed on the turntable 16. Furthermore, the wrapping assembly 22 is located above the product 12 to allow the product 12 to be placed on the turntable 16 without interference with the wrapping assembly 22. As illustrated in FIG. 1, the stretch wrap 20 extends between the source 18 of stretch wrap 20 and a vehicle 38 (described in more detail below). The vehicle 38 in FIG. 1 holds the portion 24 of the stretch wrap 20 comprising a leading end 24' of the stretch wrap 20. Thereafter, the wrapping assembly 22 lowers as illustrated in FIGS. 2 and 3 to position the stretch wrap machine 10 in a start position for beginning to wrap the product 12. In the start position, the stretch wrap 20 forms into a first triangular part 25 and a second rope part 27, with the stretch wrap 20 forming a rope transition point 29 between the first triangular part 25 and the second rope part 27 on a top corner 31 of the product 12.

Figure 4:
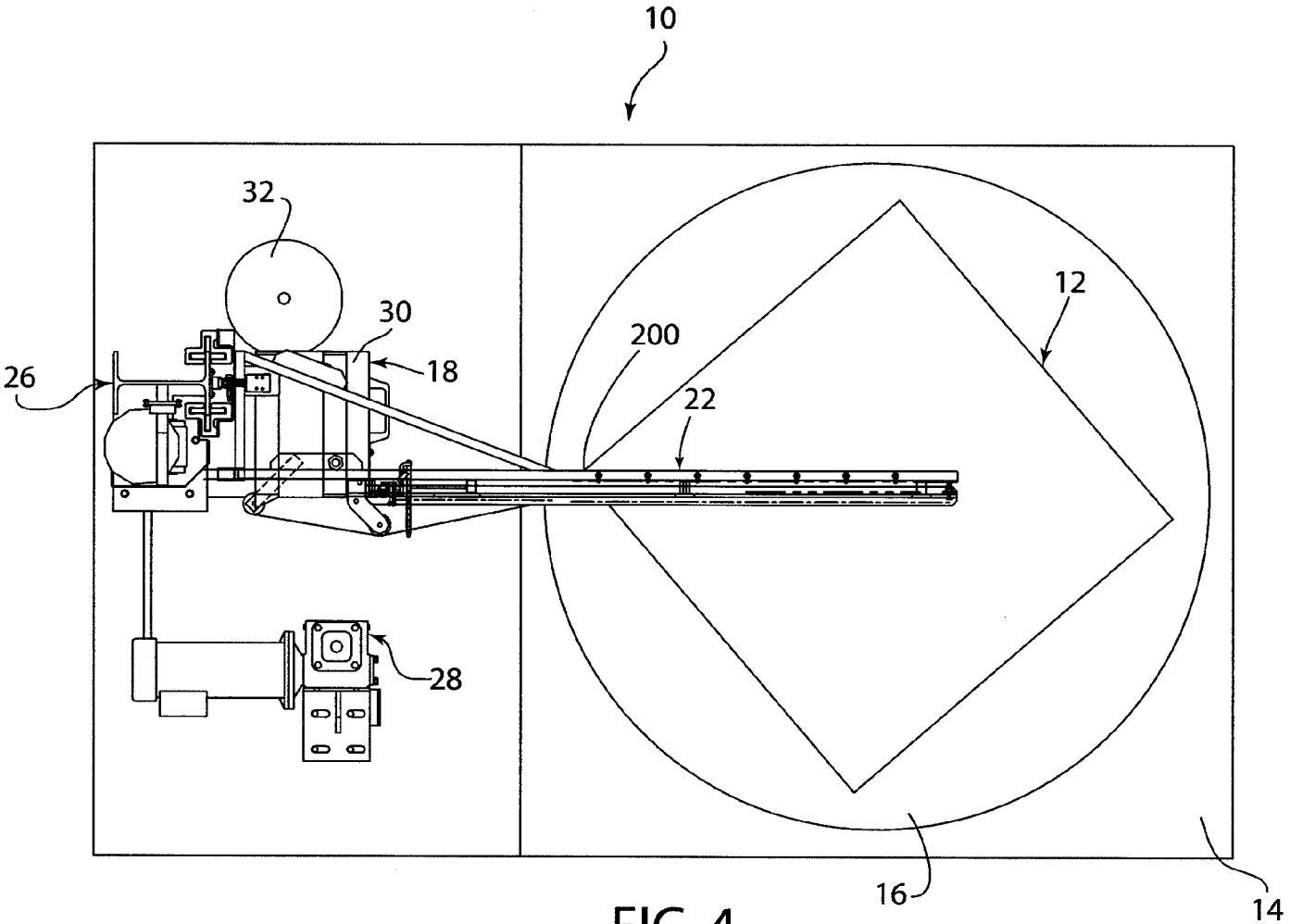
FIG. 4 is top view of the stretch wrap machine of the present invention in a first rotated position at a beginning of rotation of a product and with the cover of the column and carriage removed to show details of the machine.
Figure 5A:
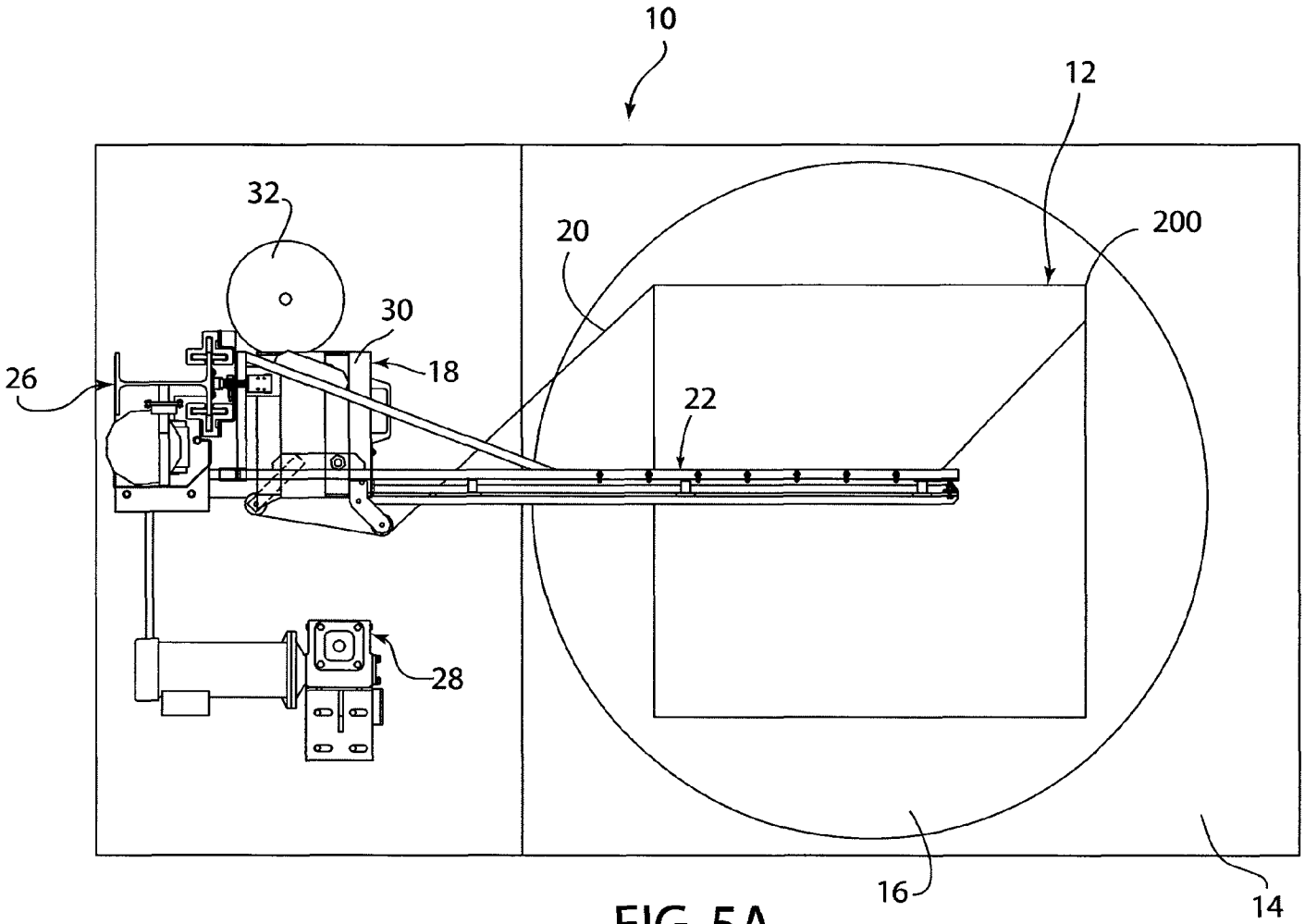
FIG. 5A is top view of the stretch wrap machine of the present invention in a second rotated position and with the cover of the column and carriage removed to show details of the machine.
Figure 5B:
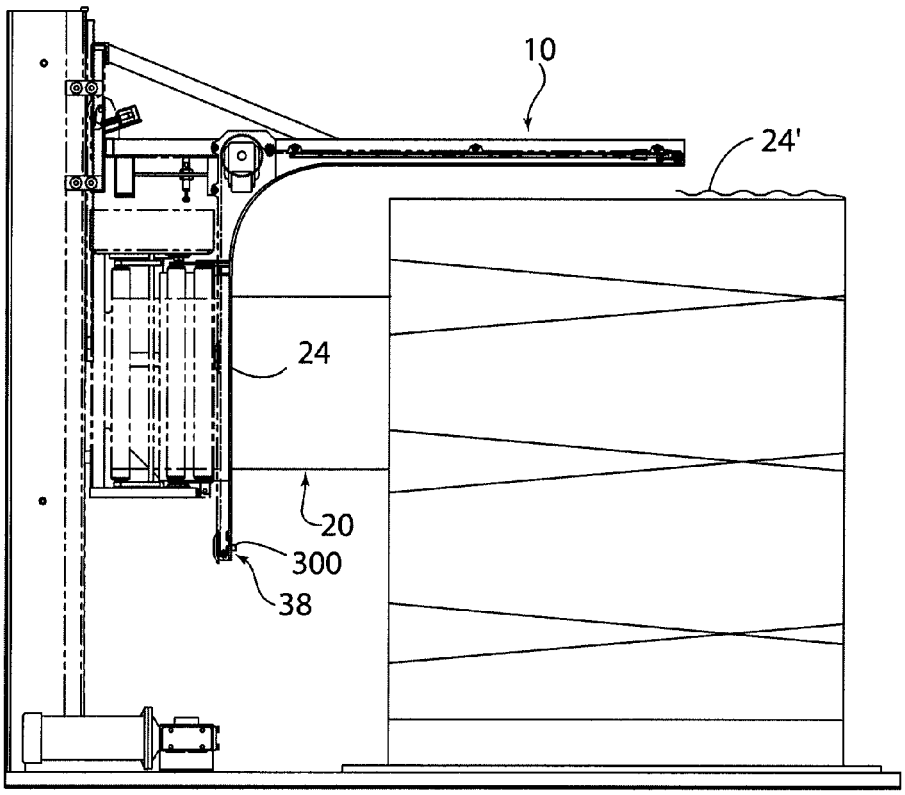
FIG. 5B is a front view of the stretch wrap machine of the present invention in a wrapping position.

The stretch wrap machine 10 then begins to wrap the product 12 by rotating the turntable 16 as illustrated in FIG. 4. At first, the rope transition point 29 will move along the top corner 31 of the product 12. However, when the rope transition point 29 meets a corner 200 of the product 12, the rope transition point 29 will catch on the corner 200 and move therewith as illustrated in FIG. 5A, thereby beginning to wrap the product 12 with the stretch wrap 12. The source 18 of stretch wrap 20 will then begin to move vertically to wrap the sides of the product 12. After the product 12 has been wrapped at least one time (including after the product 12 has been completely wrapped), the leading end 24' of the stretch wrap 20 will drop onto the top of the product 12. Thereafter, the vehicle 38 will move to a bottom of the wrapping assembly 22 as illustrated in FIG. 5B.

Figure 5C:
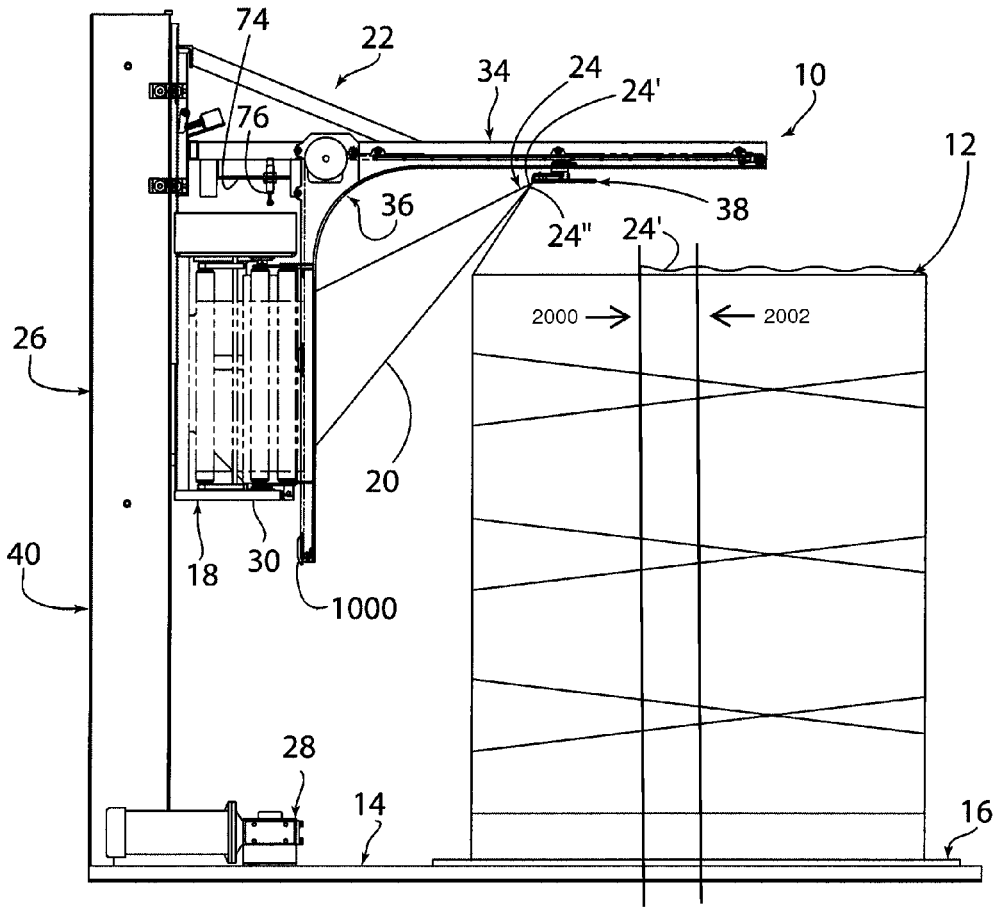
FIG. 5C is a front view of the stretch wrap machine of the present invention in an end of wrapping position.
Figure 5D:
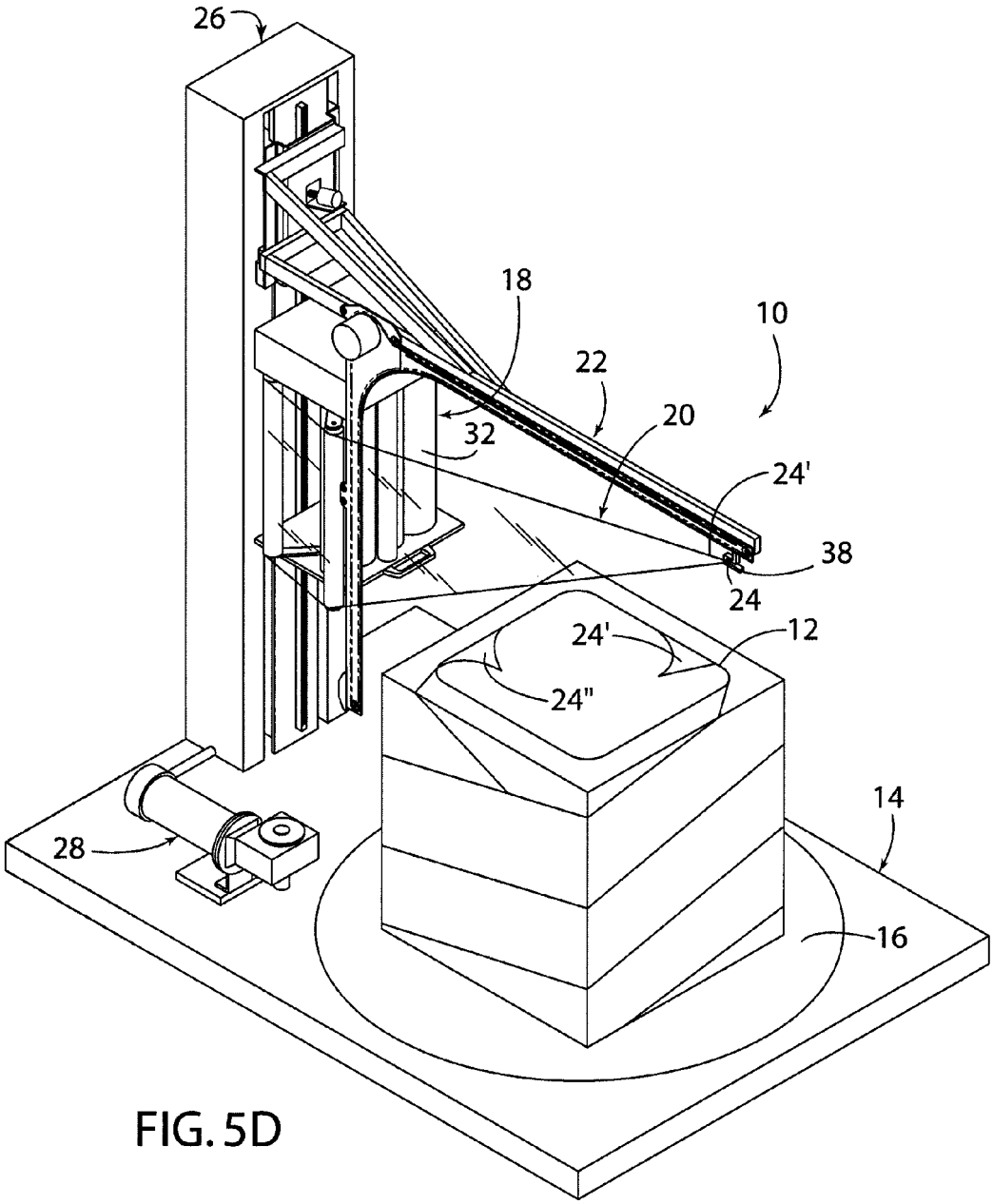
FIG. 5D is a perspective view of the stretch wrap machine of the present invention in a final position.
Figure 6:
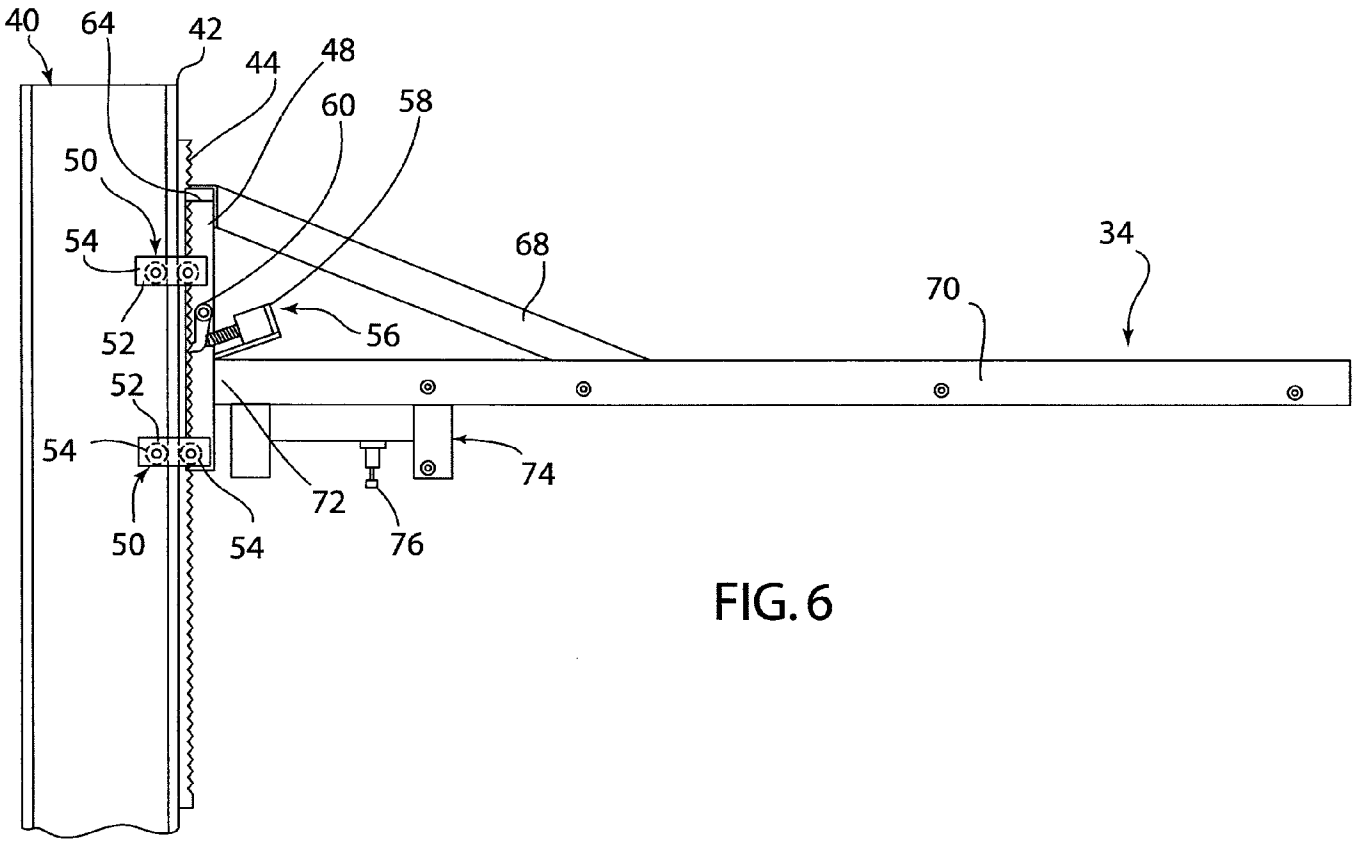
FIG. 6 is a front view of an arm of a wrapping assembly and an I-beam of the present invention.

To finish wrapping the product 12 in the illustrated example, the vehicle 38 will move upward and grab the portion 24 of the stretch wrap 20. At this point, the portion 24 includes a trailing end 24" of the stretch wrap 20 about the product 12 and a second leading end 24' of the stretch wrap (i.e., a leading end 24' for the stretch wrap 20 for a subsequent product to be wrapped). The portion 24 is moved above the product 12 as illustrated in FIG. 5C. Thereafter, the portion 24 is cut to thereby drop the trailing end 24" on top of the product 12. Accordingly, the portion 24 is cut at a position above the product 12 such that a cutting line 2000 parallel to an axis of rotation 2002 of the turntable 16 extends through the portion 24 and the product 12 when the portion 24 is cut. The product 12 is therefore fully wrapped and can be removed from the turntable 16 and the wrapping machine 10 is positioned again in the initial position of FIG. 1. As used herein, the portion 24 of the stretch wrap 20 can comprise the leading end 24', the trailing end 24" or a combination of both the leading end 24' and the trailing end 24". The elements of the illustrated embodiment the stretch wrap machine 10 will now be described.

In the illustrated example, the base 14 includes the turntable 16 for rotating the product 12 and a column 26 supporting the source 18 of stretch wrap 20 and the wrapping assembly 22. The turntable 16 is preferably circular and configured to have the product 12 placed thereon. The turntable 16 is connected to a motor 28 preferably via an endless band (e.g., a chain) that is activated to rotate the turntable 16. However, it is contemplated that the turntable 16 can be connected to the motor 28 using other means. The motor 28 is operatively connected to a control system (not shown) that rotates the turntable 16 during the wrapping process. The base 14 and turntable 16 are well known to those skilled in the art.

The illustrated column 26 extends upwardly from the base 14 and has the source 18 of stretch wrap 20 connected thereto. The source 18 of stretch wrap 20 is located on a carriage 30 that moves the source 18 of stretch wrap 20 vertically between a position above a top and a bottom of the product 12 in order to wrap the product 12. Preferably, the source 18 of stretch wrap 20 includes a roll 32 of stretch wrap 20 placed on the carriage 30. The carriage 30 preferably prestretches the stretch wrap 20 in order to lengthen the stretch wrap 20 in a manner known to those skilled in the art. The carriage 30 can be moved vertically on the column 26 by many methods, all of which are well known to those skilled in the art. The carriage 30 also includes a source of power connected thereto in a manner well known to those skilled in the art. The carriage and its manner of loading and moving on the column are conventional and well known to those skilled in the art.

In the illustrated example, the wrapping assembly 22 uses the stretch wrap 20 from the source 18 of stretch wrap 20 to wrap the product 12. The wrapping assembly 22 includes an arm 34 extending from the column 26, a track 36 connected to the arm 34 and a vehicle 38 that travels along the track 36 to bring the portion 24 of the stretch wrap 20 to a position above the turntable 16 after a first product is wrapped and before a second product 12 is wrapped. The vehicle 38 also cuts the portion 24 of the stretch wrap 20 after the product 12 has been wrapped.

The illustrated arm 34 (FIGS. 6-8A) moves vertically along the column 26 to move the track 36 and the vehicle 38 vertically. The arm 34 of the wrapping assembly 22 rides on an I-beam 40 of the column 26. Preferably, the carriage 30 also rides on the I-beam 40 such that the arm 34 of the wrapping assembly 22 can be connected to the existing structure of currently manufactured wrapping machines (that had previously been made without the wrapping assembly 22 of the present invention.) The I-beam 40 includes a front plate 42 upon which the arm 34 rides and a centrally located and vertically aligned ratchet plate 44 on the front plate 42. As discussed in more detail below, the arm 34 interconnects with the ratchet plate 44 to stop the lowering of the aim 34.

Figure 7:
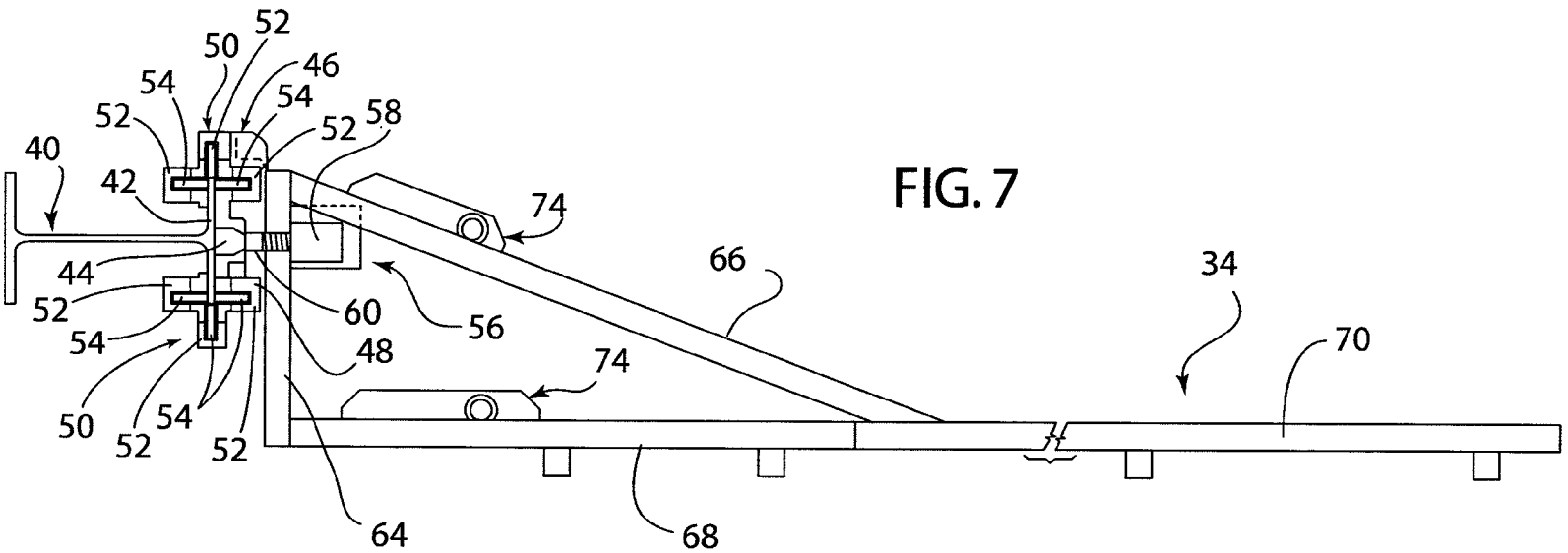
FIG. 7 is a top view of the arm of the wrapping assembly and the I-beam of the present invention.

In the illustrated example, the arm 34 includes a guide plate 46 that rides on the front plate 42 of the I-beam 40. The guide plate 46 includes a front panel 48 and a pair of three-pronged roller guides 50 on each side of the front panel 48. The three-pronged roller guide portion 50 each include three pockets 52 having a roller 54 therein. The rollers 54 in the roller guide portions 50 are configured to roll on a front side, a rear side and an end edge of each side of the front plate 42 of the I-beam 40. In FIG. 7, a top of the housing enclosing the rollers 54 is removed to show the rollers 54. Accordingly, two of the rollers 54 are parallel and the third roller 54 (the roller rolling on the end edge of the front plate 42) is orientated perpendicular to the parallel rollers 54. The front panel 48 of the guide plate 46 of the arm 34 includes a stopping mechanism 56 connected thereto. The stopping mechanism 56 includes a solenoid 58 and a pawl 60. The pawl 60 is rotatably connected to the front panel 48 and is rotated through actuation of the solenoid 58. The pawl 60 is configured to extend through an opening 62 (see FIG. 8) in the front panel 48. During use of the wrapping assembly 22, the control system for the stretch wrap machine 10 will activate the solenoid 58 to rotate the pawl 60 through the opening 62 and into contact with the ratchet plate 44 to stop downward movement of the arm 34. Preferably, the pawl 60 will only prevent downward movement of the arm 34, but will allow the arm 34 to move upwards. Although an embodiment of the stretch wrap machine 10 including the I-beam 40 and the guide plate 46 for moving the arm 34 and a solenoid 58 and pawl 60 for stopping movement of the arm 34 are illustrated, it is contemplated that the arm 34 could move along the column 26 in any manner and stop vertically relative to the column 26 in any manner.

The illustrated arm 34 includes a top beam 64, a side support beam 66, a top support beam 68, a cantilever beam 70 and a side beam 72 extending from the guide plate 46. The top beam 64 extends horizontally from a top of the guide plate 46 and the side beam 72 extends horizontally from a lower portion of the guide plate 46. The top beam 64 and the side beam 72 are illustrated as being parallel. The cantilever beam 70 extends forwardly from an end of the side beam 72. The top support beam 68 extends forwardly and downwardly from an end of the top beam 64 and a central portion of the cantilever beam 70. Furthermore, the side support beam 66 extends laterally and forwardly from a side of the guide plate 46 to a central portion of the cantilever beam 70. The cantilever beam 70 and the side support beam 66 each include a shock absorber support 74 having a shock absorber 76 thereon. The shock absorbers 76 are configured to abut against a top of the carriage 30 such that the arm 34 rides upward and downward on the carriage 30 until the solenoid 58 actuates the pawl 60 to stop movement of the arm 34 (see FIGS. 1-2, which show the shock absorbers 76 directly above the carriage 30). The track 36 is connected to the cantilever beam 70.

Figure 9:
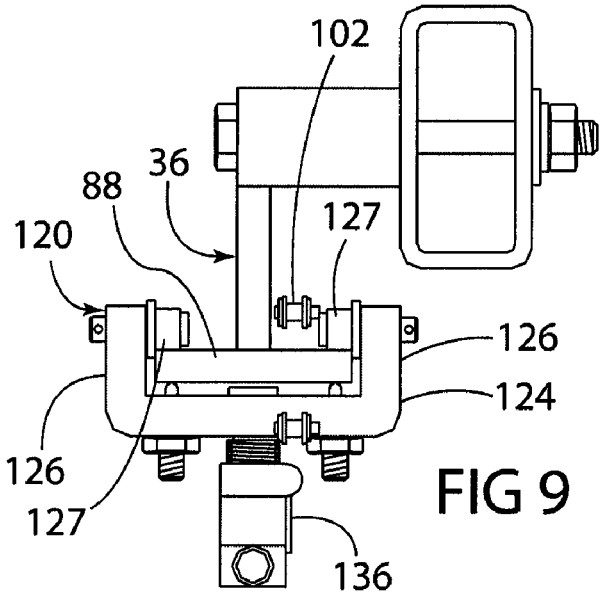
FIG. 9 is a side view of a track, a vehicle and a cantilever beam of the arm of the wrapping assembly of the present invention.
Figure 8:
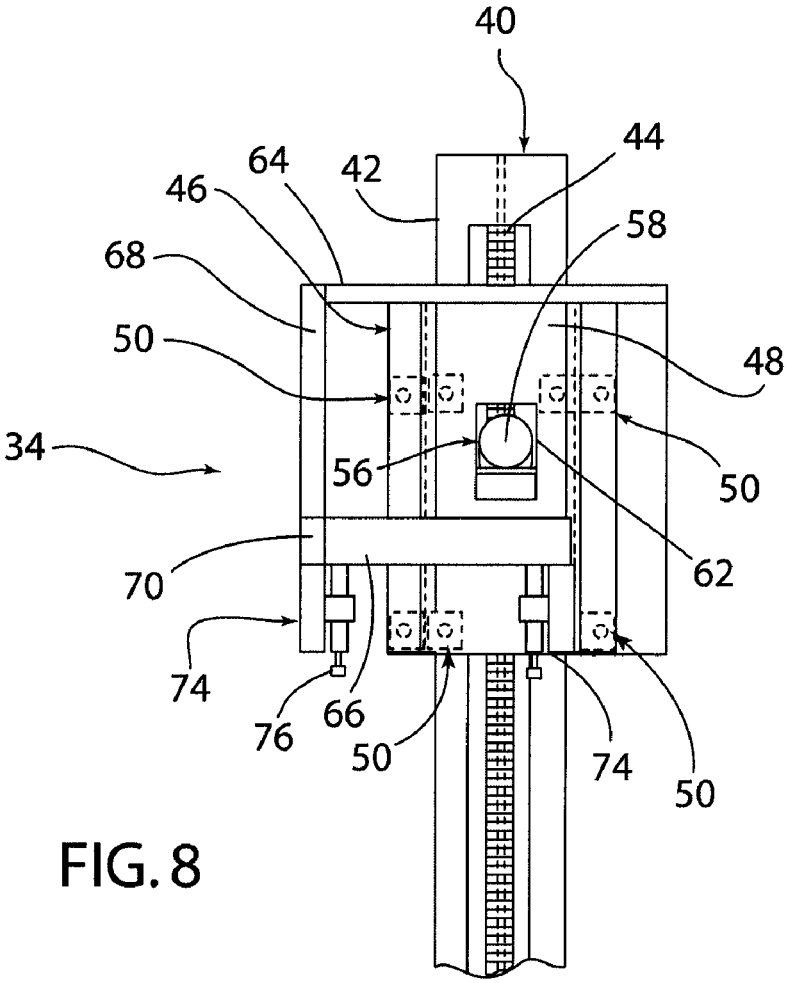
FIG. 8 is a side view of the arm of the wrapping assembly and the I-beam of the present invention.
Figure 8A:
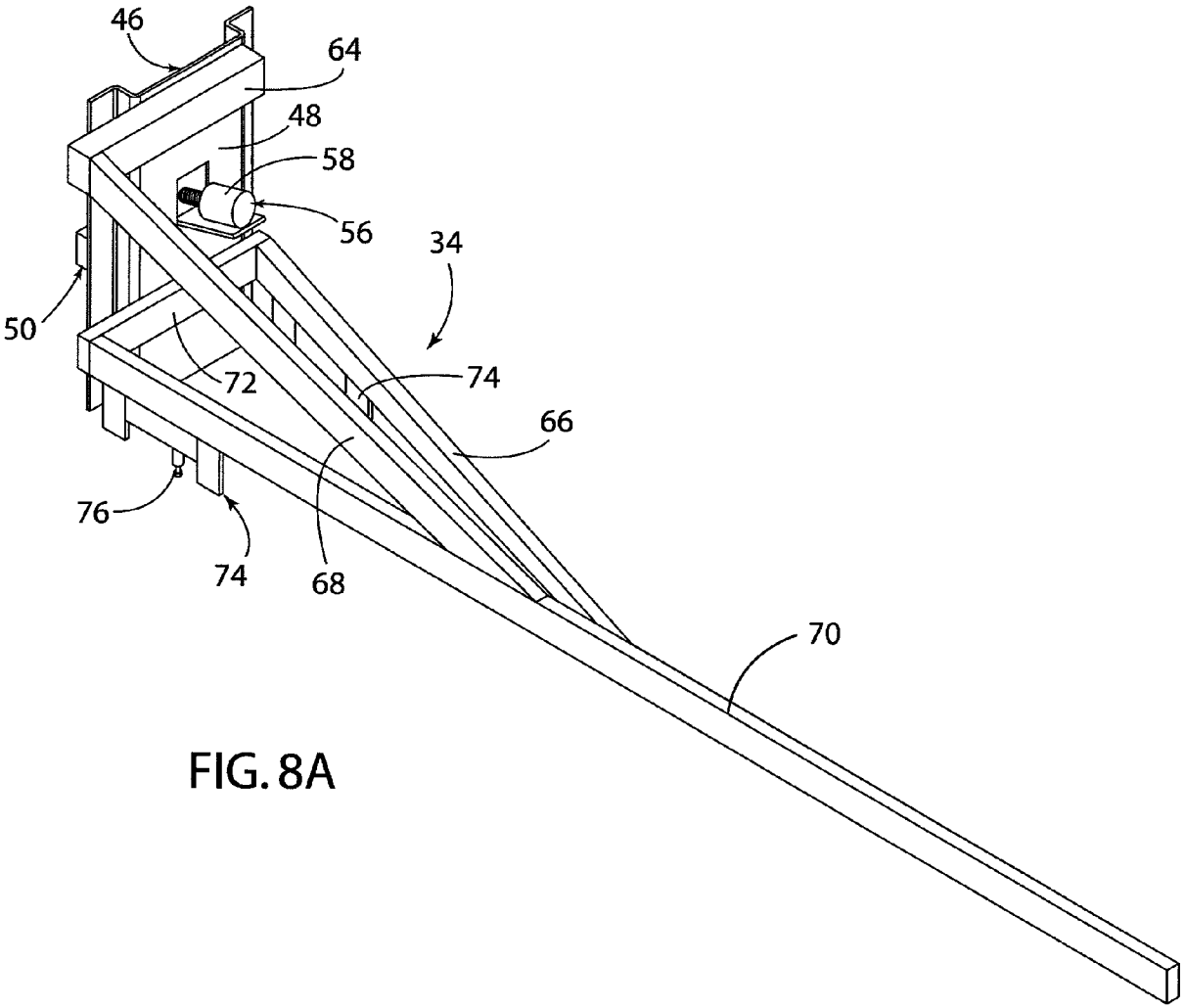
FIG. 8A is a perspective view of the arm of the wrapping assembly of the present invention.
Figure 10:
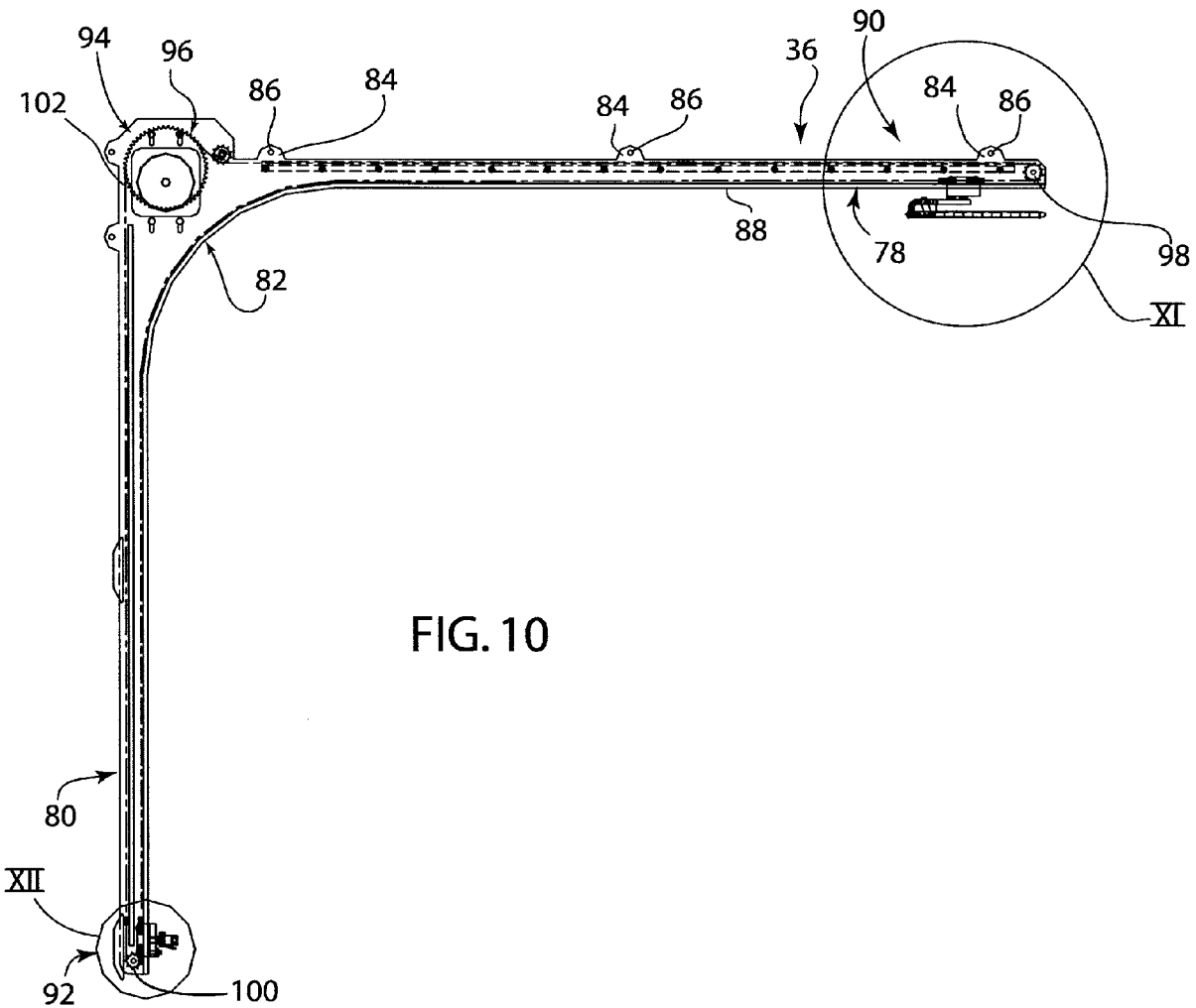
FIG. 10 is a front view of the track and a vehicle of the wrapping assembly of the present invention.
Figure 11:
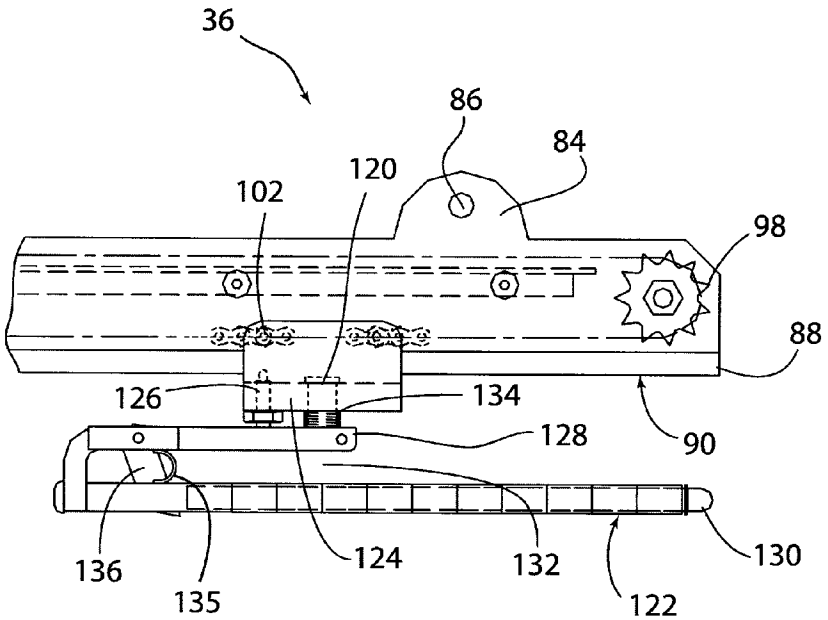
FIG. 11 is a close-up view of the track and the vehicle taken from the circle XI of FIG. 10.
Figure 12:
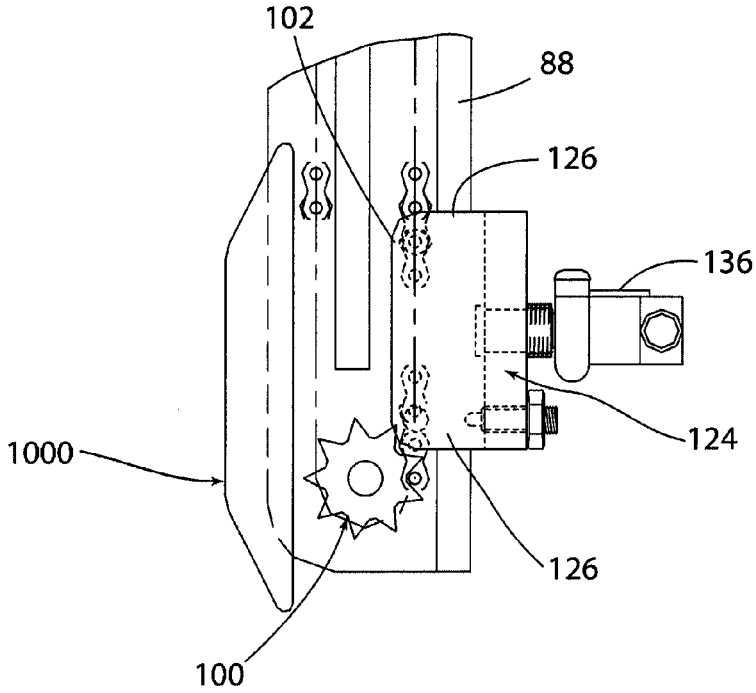
FIG. 12 is a close-up view of the track and the vehicle taken from the circle XII of FIG. 10.
Figure 13:
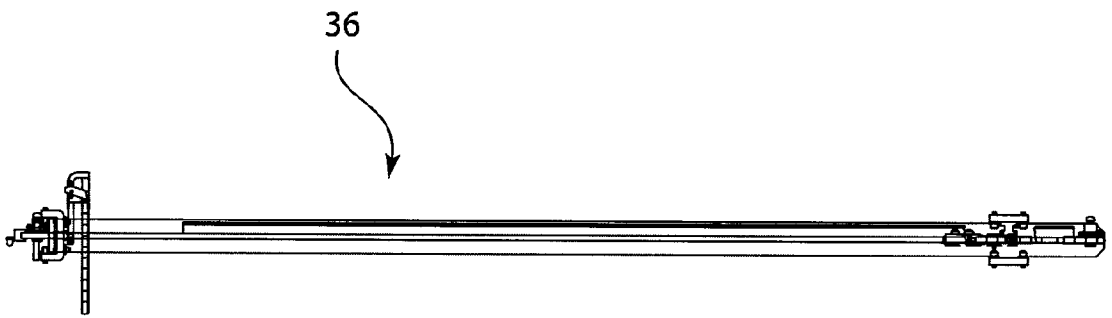
FIG. 13 is a top view of the track of the wrapping assembly of the present invention.
Figure 14:
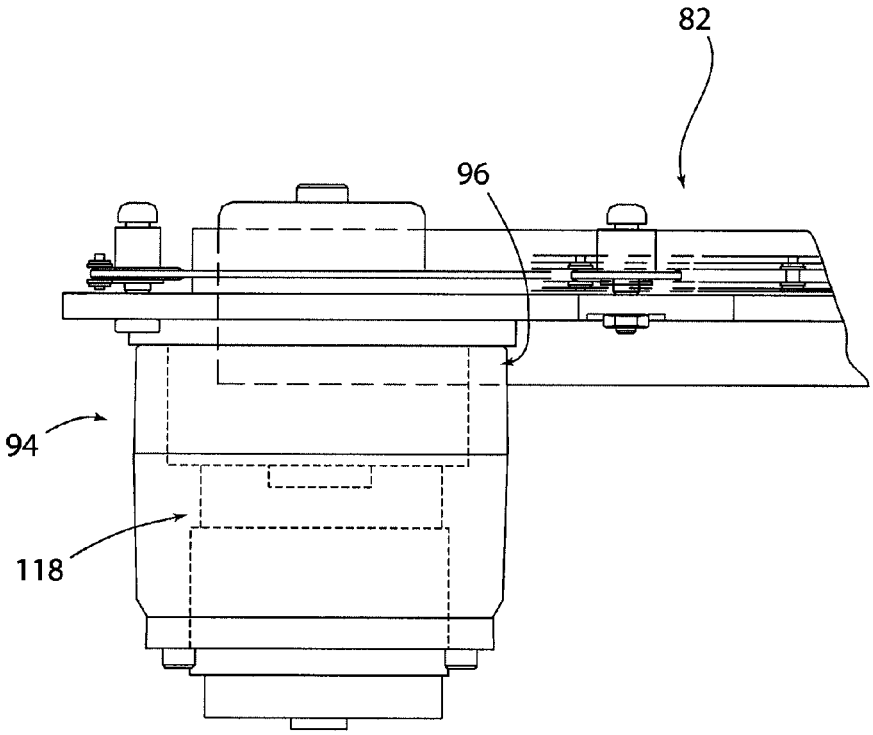
FIG. 14 is a close-up top view of a motor support and transition section of the track of the wrapping assembly of the present invention.

In the illustrated example, the vehicle 38 moves on the track 36 (FIGS. 10-14) to bring the stretch wrap 20 to a position above the product 12. The track 36 includes a horizontal section 78, a vertical section 80, and a motor support and transition section 82. The horizontal section 78 includes a plurality of ears 84 having holes 86 therethrough for accepting fasteners to connect the horizontal section 78 of the track 36 to the cantilever beam 70. The horizontal section 78, the vertical section 80, and the motor support and transition section 82 each have an inverted T-shaped cross section (see FIG. 9 showing the end of the horizontal section 78 connected to the cantilever beam 70 or the arm 34) and define a continuous rail 88 along the bottom of the horizontal section 78 and a right side of the vertical section 80 as shown in FIG. 10. The vehicle 38 rides along the continuous rail 88 between an outermost end 90 (FIG. 11) of the horizontal section 78 and a lowest end 92 (FIG. 12) of the vertical section 80 of the track 36. Although only one vehicle 38 is used in the illustrated embodiment, FIG. 10 illustrates the vehicle 38 at both the outermost end 90 and the lowest end 92 (even though the vehicle 38 would be at only one of these locations). The track 36 includes a drive assembly 94 for moving the vehicle 38. The drive assembly 94 includes a motor and sprocket assembly 96 on the motor support and transition section 82, a first sprocket 98 on the outermost end 90 of the horizontal section 78, a second sprocket 100 of the lowest end 92 of the vertical section 80, and a chain 102 connected to the motor and sprocket assembly 96, the first sprocket 98 and the second sprocket 100. The motor and sprocket assembly 96 includes a motor 118 for moving a portion of the chain 102 connected to the vehicle 38 between the outermost end 90 of the horizontal section 78 and the lowest end 92 of the vertical section 80 of the track 36.

The illustrated vehicle 38 moves along the rail 88 of the track 36 to bring the portion 24 of the stretch wrap 20 to a position above the product 12. The vehicle 38 includes a support 120 that rides on the rail 88 and is connected to the chain 102. The vehicle 38 also includes a finger 122 rotatably connected to the support 120. The support 120 comprises a plate 124 with four legs 126 having rollers 127 thereon for rolling on the rail (see FIG. 9) and surrounding the rail 88 and being connected to the chain 102. The finger 122 extends from the plate 124 of the support 120 and includes a first portion 128 and a second portion 130 defining a pocket 132. A torsion spring 134 provides a bias to the finger 122 to rotate the finger 122 into a lateral position (see FIG. 12). The finger 122 includes a resilient reverse C-shaped spring wedge 135 configured to capture the stretch wrap 20 within the pocket 132 and a blade 136 for cutting a portion of the stretch wrap 20.

During use, the stretch wrap machine 10 begins the wrapping procedure by moving the carriage 30 and the wrapping assembly 22 to an uppermost position on the column 26. At this point, the portion 24 of the stretch wrap 20 is held within the pocket 132 of the finger 122 of the vehicle 38 of the wrapping assembly 22 by the resilient spring wedge 135 or any other spring-like member. Furthermore, the portion 24 of the stretch wrap 20 will pull the finger 122 against the bias of the torsion spring 134 such that the finger 122 will be in an aligned position (as shown in FIGS. 1, 2, 10 and 11). Thereafter, the product 12 is placed on the turntable 16, and the carriage 30 and the wrapping assembly 22, which can ride on the carriage 30, is lowered. The arm 34 of the wrapping assembly 22 preferably includes an electronic eye for determining a distance from the top of the product 12. The electronic eye will activate the solenoid 58, which will rotate the pawl 60 into contact with the ratchet plate 44 to prevent any further downward movement of the arm 34, when the arm 34 is a predetermined distance above the product 12 (see FIG. 2). At this point, the stretch wrap machine 10 is ready to begin wrapping the product 12 with the stretch wrap 20.

In the illustrated example, after the arm 34 has been lowered to the position above the product 12, the turntable 16 will begin to rotate (see FIGS. 4 and 5A). As the turntable 16 rotates, the corner 200 of the product 12 will catch the rope transition point 29 of the stretch wrap 20 between the vehicle 38 and the source 18 of stretch wrap 20 and begin pulling the stretch wrap 20 around the product 12. Furthermore, the carriage 30 will move the source 18 of stretch wrap 20 vertically to allow the stretch wrap 20 to surround an outside of the product 12 between a top portion and a bottom portion of the product 12. The method of wrapping the product 12 with the stretch wrap 20 between the top portion and the bottom portion of the product 12 is well known to those skilled in the art. Furthermore, the corner 200 of the product will pull the leading end 24' of the stretch wrap 20 out of the resilient spring wedge 135 in the pocket 132 of the finger 122 of the vehicle 38, thereby positioning the leading end 24' of the stretch wrap 20 to rest on the top of the product 12. Furthermore, the vehicle 38 will move from the aligned position to the lateral position as shown in FIG. 5B because the stretch wrap 20 is no longer working against the bias of the spring 134.

At any time during the wrapping of the product 12 or after the product 12 is wrapped with the stretch wrap 20, the motor 118 of the track 36 is activated to move the chain 102 and thereby the vehicle 38 from the outermost end 90 of the horizontal section 78 to the lowest end 92 of the vertical section 80 of the track 36. If the stretch wrap 20 extending from the source 18 of stretch wrap 20 to the product 12 is in the way of the vehicle 38 as the vehicle 38 travels down the vertical section 80 of the track 36, the finger 122 can move to the aligned position against the bias of the torsion spring 134 as the finger 122 abuts the stretch wrap 20 to allow the vehicle 38 to move past the stretch wrap 20. Furthermore, the arm 34 includes a deflector 1000 for moving the arm 34 away from the carriage 30 as the arm 34 passes the carriage 30.

After the product 12 has been wrapped by the stretch wrap 20, the motor 118 of the track 36 is activated to move the chain 102, and thereby the vehicle 38, up the vertical section 80 of the track 36. As the vehicle 38 moves against the stretch wrap 20, a top 300 of the finger 122 (see FIG. 5B) will collect the stretch wrap 20 as the vehicle 38 will not be able to rotate out of the way of the stretch wrap 20. Once the vehicle 38 makes a transition from the vertical section 80 of the track 36 to the horizontal section 78 of the track 36, the stretch wrap 20 will be pulled into the pocket 132. At this point, the vehicle 38 is still in the lateral position. However, once the stretch wrap 20 is fully inserted into the pocket 132, the vehicle 38 will begin to rotate to the aligned position due to the pulling force of the stretch wrap 20 from the source 18 of stretch wrap 20 on one end. As the vehicle 38 rotates, the blade 136 will rotate into contact with the stretch wrap 20 located between the finger 122 and the product 12. Therefore, the blade 136 will cut the stretch wrap 20 and place the trailing end 24" of the stretch wrap 20 on the top of the product 12. Accordingly, both ends of the stretch wrap surrounding the product will be on top of the product. Furthermore, the leading end 24' of the stretch wrap 20 from the source 18 of stretch wrap 20 will be held within the finger 122 by the resilient spring wedge 135. At this point, the product 12 can be removed from the turntable 16, a new or second product can be placed on the turntable 16 and the process for wrapping can start again.

Figure 15A:
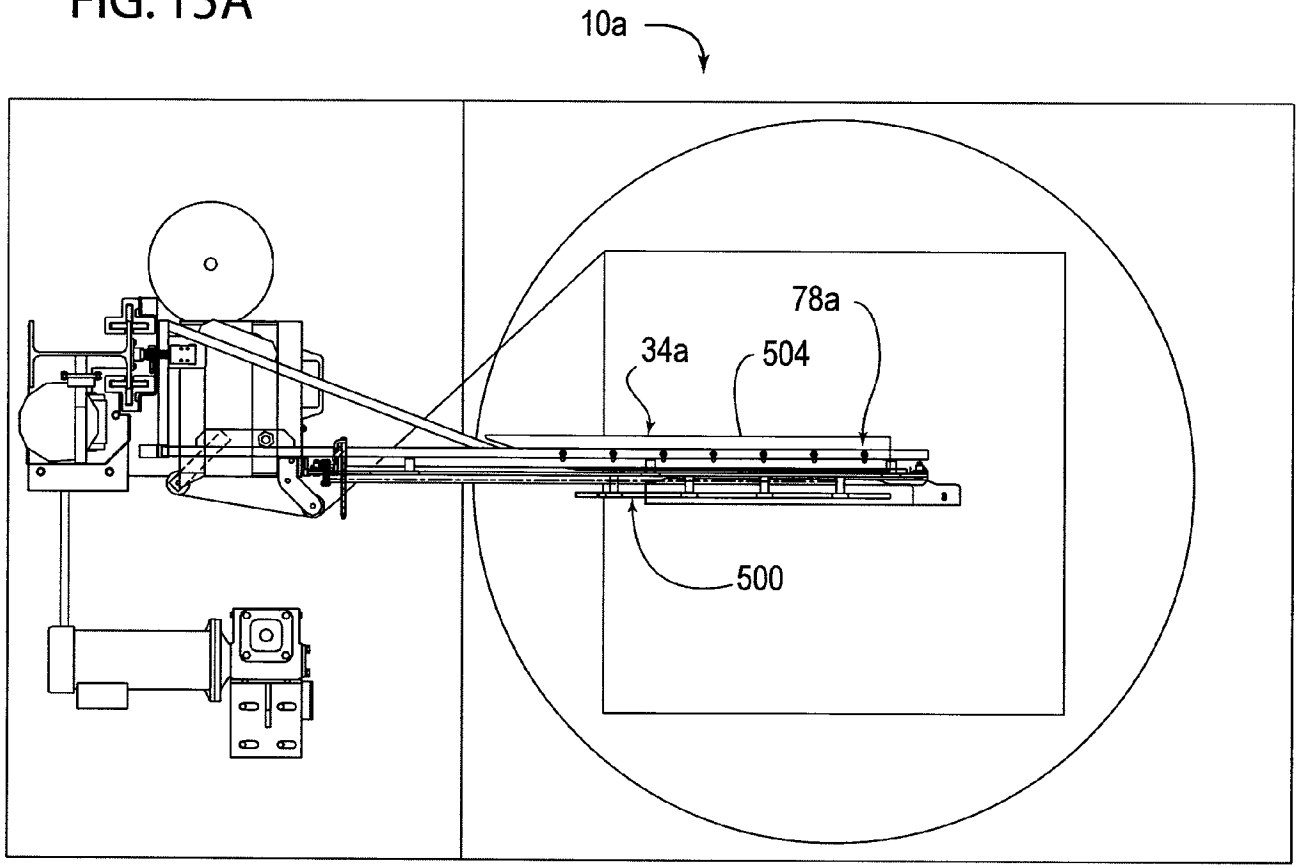
FIG. 15A is a top view of the stretch wrap machine of a second embodiment of the present invention.
Figure 15B:
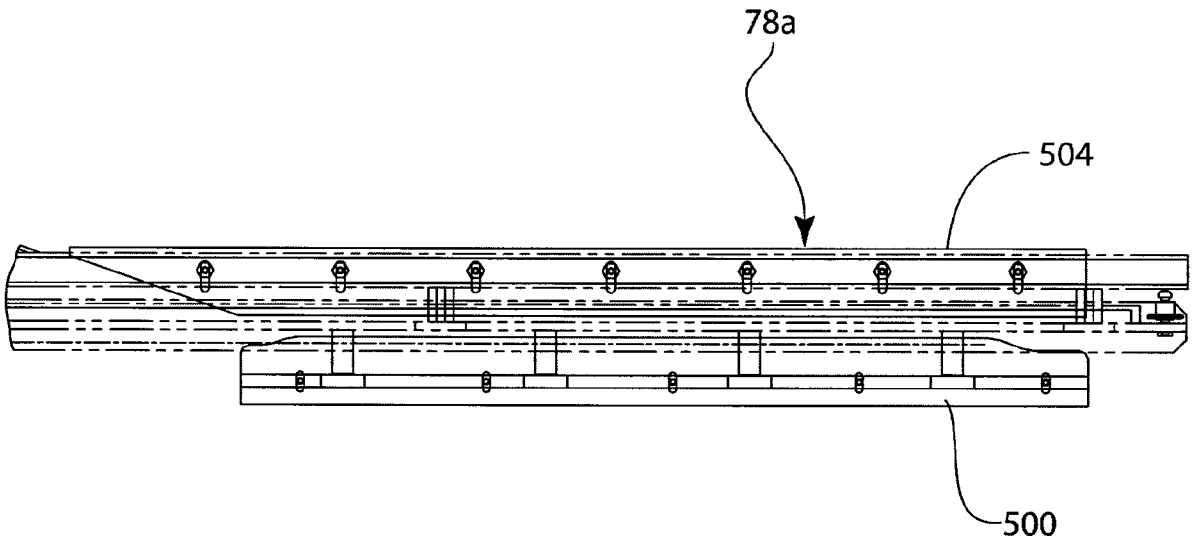
FIG. 15B is a top view of an end of the arm and track of the wrapping assembly of the second embodiment of the present invention.
Figure 15C:
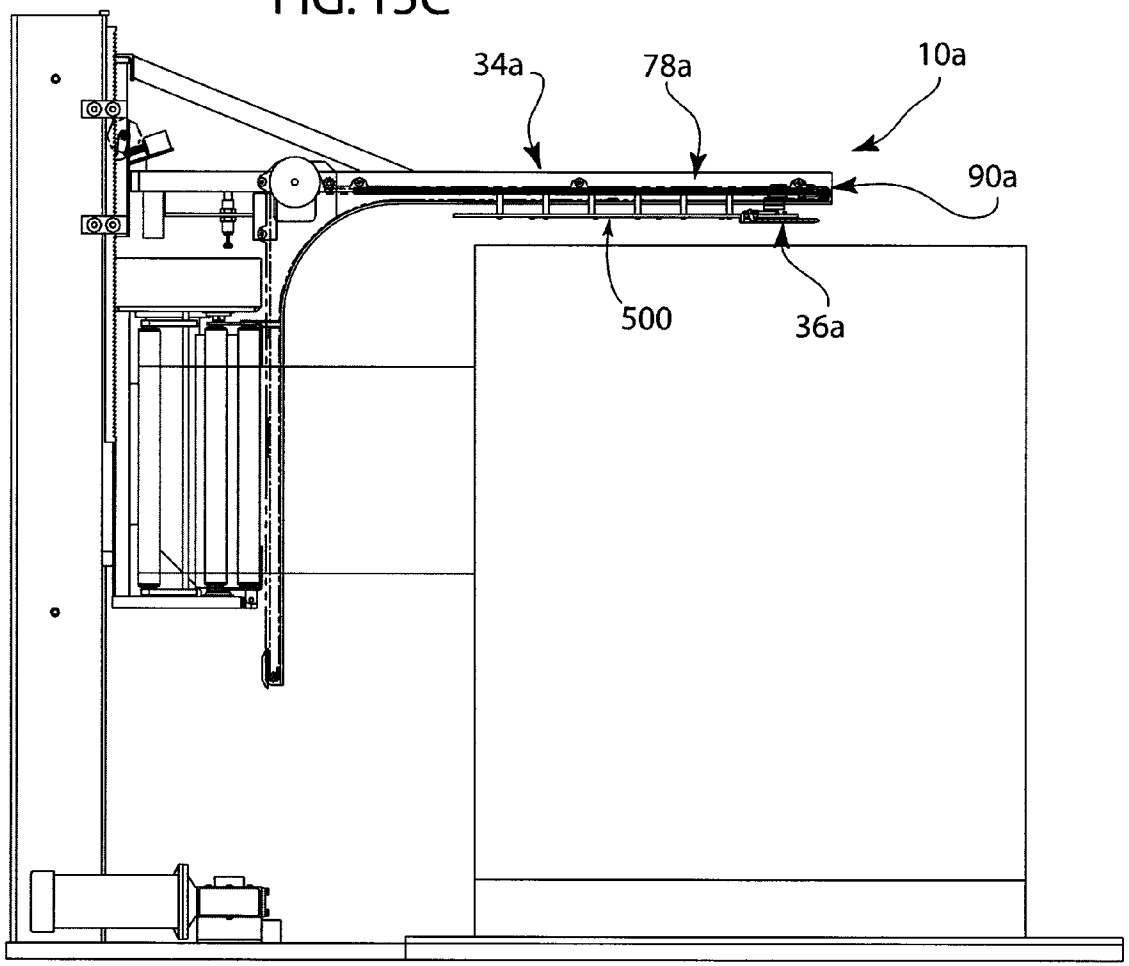
FIG. 15C is a front view of the stretch wrap machine of the second embodiment of the present invention.
Figure 15D:
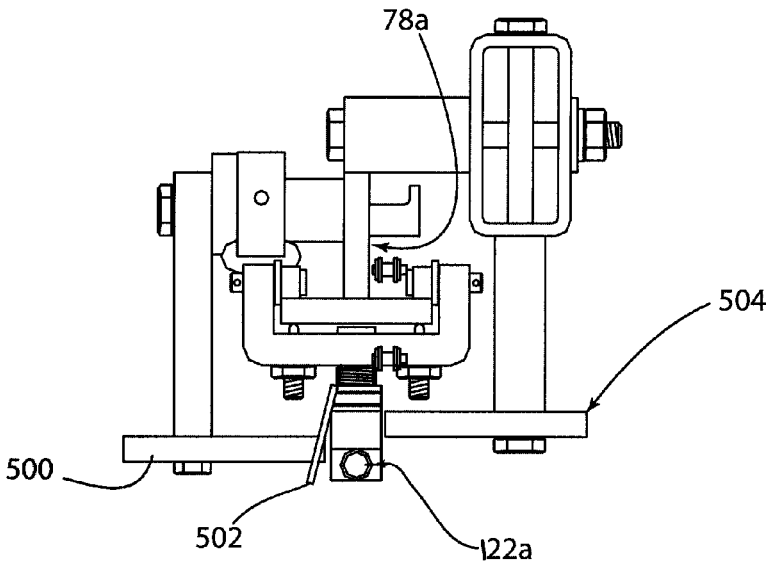
FIG. 15D is a side view of a track, a vehicle and a cantilever beam of the arm of the wrapping assembly of the second embodiment of the present invention.
Figure 16:
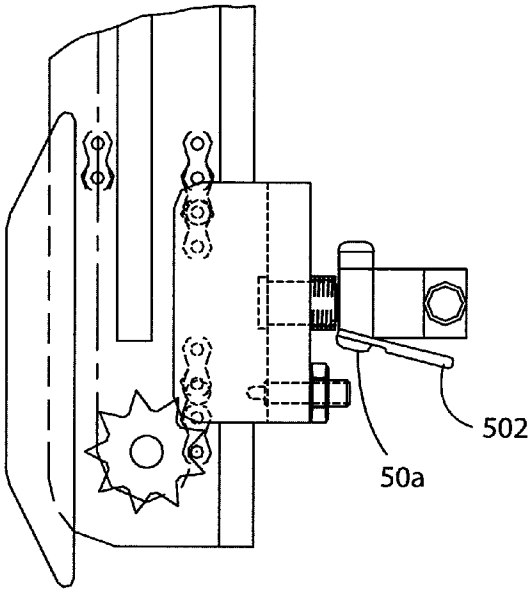
FIG. 16 is a front of a bottom of the track of the second embodiment of the present invention.
Figure 16A:
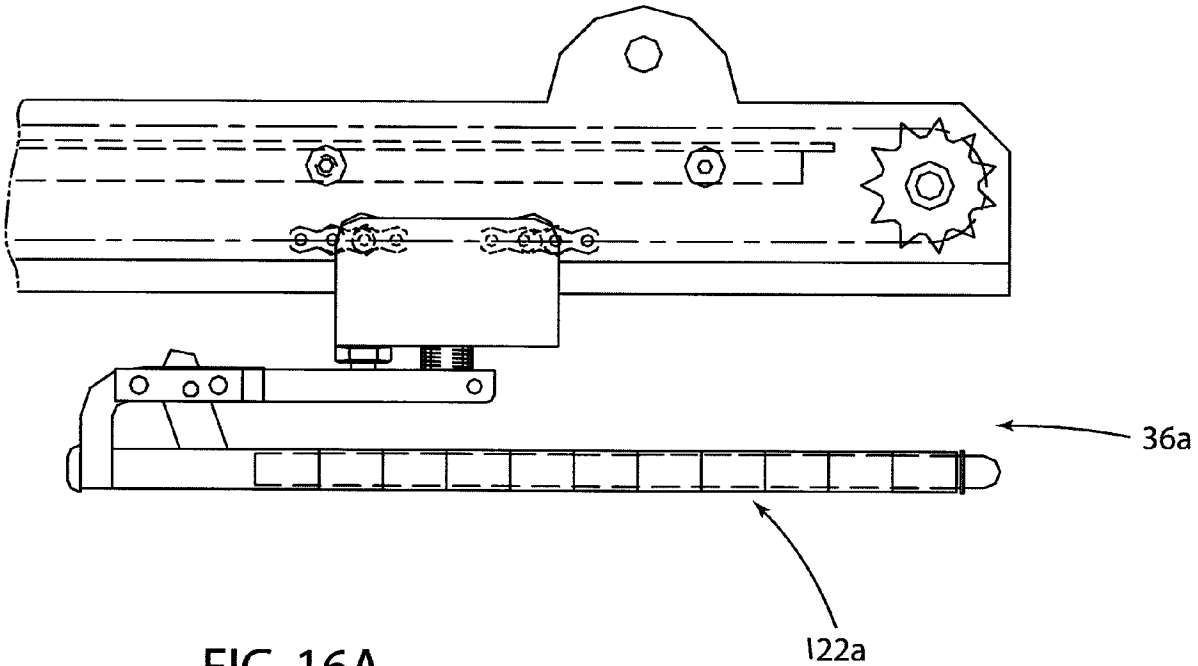
FIG. 16A is a front view of the end of the track and the vehicle of the second embodiment of the present invention.
Figure 17:
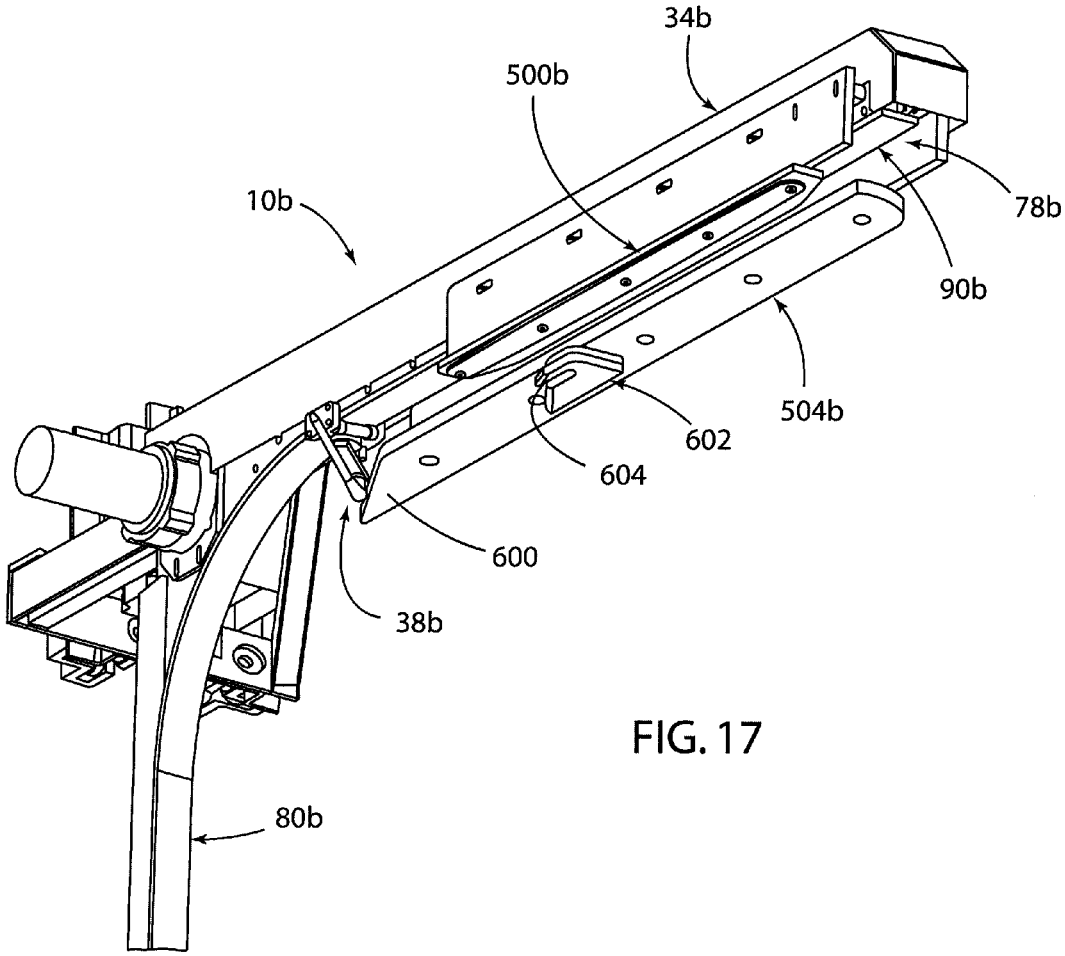
FIG. 17 is a perspective view of an end of the track and the vehicle of a third embodiment of the present invention, with the vehicle in a first position on the track.

The reference numeral 10*a* (FIGS. 15A-16A) generally designates another embodiment of the present invention, having a second embodiment for the stretch wrap machine. Since stretch wrap machine 10*a* is similar to the previously described stretch wrap machine 10, similar parts appearing in FIGS. 1-14 and FIGS. 15A-16A, respectively, are represented by the same, corresponding reference number, except for the suffix "a" in the numerals of the latter. The stretch wrap machine 10*a* is identical to the first embodiment of the stretch wrap machine 10, except that instead of capturing the portion 24 of the stretch wrap with the resilient spring wedge 135 of the finger 122, the finger 122*a* includes a plastic flap 502 (see FIG. 15D) that is configured to capture the portion 24 of the stretch wrap 20 between the plastic flap 502 and a first cam 500 extending from the horizontal section 78*a* of the arm 34*a*. Therefore, as the vehicle 38*a* moves onto the horizontal section 78*a* of the arm 34*a*, one end of the stretch wrap will come out of the source of stretch wrap and another end of the stretch wrap will surround the product, and the stretch wrap in the middle will be captured between the plastic flap 502 of the finger 122*a* and the first cam 500. It is contemplated that the vehicle 38*a* could travel almost to the outermost end 90*a* of the horizontal section 78*a* and still capture the portion of the stretch wrap 20, but can move all of the way to the outermost end 90*a* of the horizontal section 78*a* after the wrapping procedure has begun to move the portion of the stretch wrap out of being captured between the flap 502 and the first cam 500 (because the first cam 500 will end short of the outermost end 90*a*). Furthermore, instead of the finger 122*a* rotating as it travels towards the outermost end 90 of the horizontal section 78*a* by force of the stretch wrap pulling on the finger 122*a*, the finger 122*a* will rotate against a force of a second cam 504 (located on the horizontal section 78*a* of the arm 34*a* opposite to the first cam 500) that will abut against the finger 122*a* to rotate the finger 122*a*. Moreover, as the vehicle 38*a* moves to the end of the arm after the finger 122*a* has rotated, the knife will cut the stretch wrap as in the first embodiment. Therefore, the first cam 500 helps to hold an end of the stretch wrap from the source of stretch wrap in engagement with the vehicle 38*a* and the second cam 504 helps to rotate the finger 122*a* on the horizontal section 78*a* of the arm (instead of using only the tension of the stretch wrap as in the first embodiment) and to thereby cut the stretch wrap.

The reference numeral 10*b* (FIGS. 17-20) generally designates another embodiment of the present invention, having a third embodiment for the stretch wrap machine. Since stretch wrap machine 10*b* is similar to the previously described stretch wrap machine 10*a*, similar parts appearing in FIGS. 15A-16A and FIGS. 17-20, respectively, are represented by the same, corresponding reference number, except for the suffix "b" in the numerals of the latter. The stretch wrap machine 10*b* is identical to the second embodiment of the stretch wrap machine 10*a*, except with a modified vehicle 38*b* and arm 34*b*. The arm 34*b* of the third embodiment of the stretch wrap machine 10*b* includes a first cam 500*b* and a second cam 504*b*. The second cam 504*b* includes a beveled front edge 600 and a wrap collection member 602. The wrap collection member 602 extends from the bottom of the second cam 504*b* and includes a wrap collection slot 604 for collecting an end portion of the wrap when the wrap is cut as described in more detail below.

The illustrated vehicle 38*b* includes holds the wrap as described above in the first and second embodiment of the stretch wrap machine. The vehicle 38*b* includes a support 120*b* that rides on the arm 34*b* and a finger 122*b*. The finger 122*b* is rotatably connected to the support 120*b* and includes a first portion 128*b* and a second portion 130*b*. The support 120*b* includes a first stop member 606 for stopping rotational movement of the finger 122*b* in a first direction and a second stop member 608 for stopping rotational movement of the finger 122*b* in a second direction, with the first stop member 606 and the second stop member 608 abutting the first portion 128*b* of the finger 122*b* during rotation of the finger 122*b*. The finger 122*b* also includes a blade 136*b* for cutting the wrap and a wedge member 610 for holding the wrap and to assist in cutting the wrap. The second portion 130*b* of the finger 122*b* also includes a cam member 612 for rotating the finger 122*b* when the cam member 612 abuts the beveled front edge 600 of the second cam 504*b*.

Figure 18:
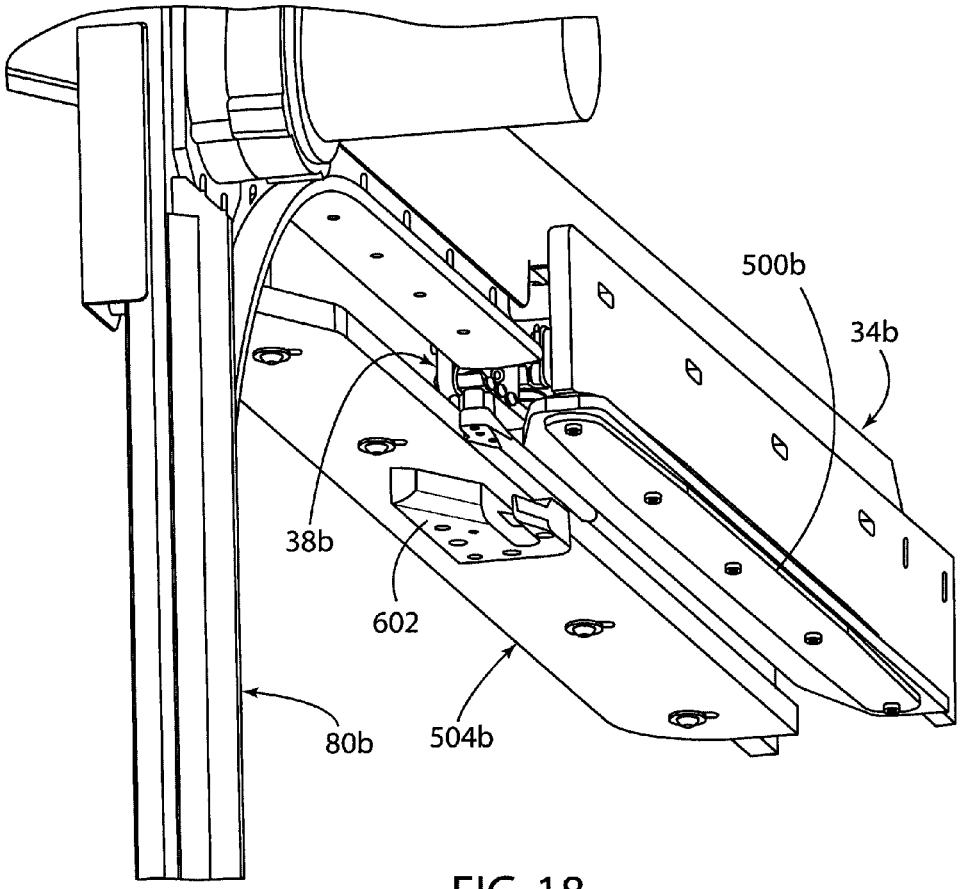
FIG. 18 is a perspective view of the end of the track and the vehicle of a third embodiment of the present invention, with the vehicle in a second position on the track.
Figure 19:
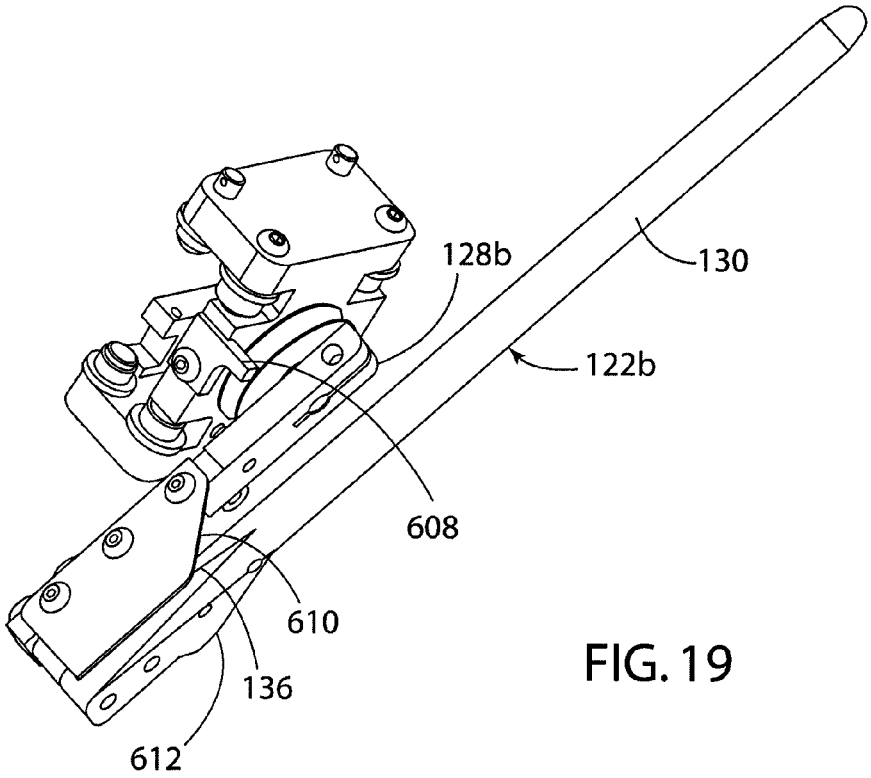
FIG. 19 is a front perspective view of the vehicle of the third embodiment of the present invention.
Figure 20:
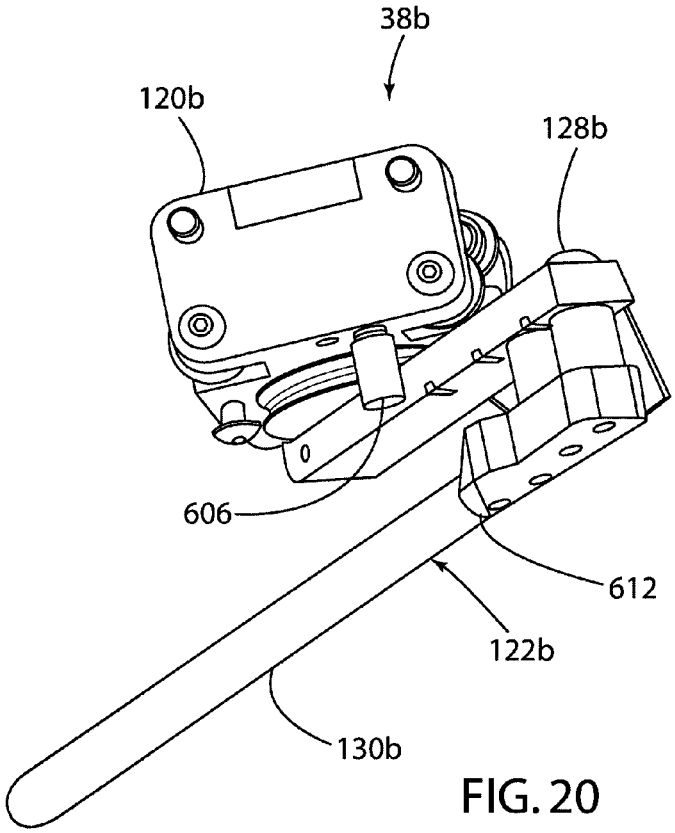
FIG. 20 is a rear perspective view of the vehicle of the third embodiment of the present invention.

In use, the finger 122*b* of the third embodiment of the stretch wrap machine 10*b* grabs the wrap as discussed above after the turntable 16 has stopped rotating and the product 12 has been wrapped. The finger 122*b* moves upward along the vertical section 80*b* of the arm 34*b* and grabs the wrap while it moves upward. As the finger 122*b* moves onto the horizontal section 78*b* of the arm 34*b*, the cam member 612 will abut the beveled front edge 600 of the second cam 504*b*, thereby rotating the finger 122*b* to be aligned with the horizontal section 78*b* of the arm 34*b* as illustrated in FIG. 18. As the finger 122*b* moves between the first cam 500*b* and the second cam 504*b*, the end of the wrap will be captured in the wrap collection slot 604 of the wrap collection member 602. When the end of the wrap is trapped by the wrap collection member 602, the vehicle 38*b* will continue to move past the wrap collection member 602 and cut the end of the wrap with the blade 136*b*, thereby dropping the end of the wrap onto the top of the product 12. Furthermore, the portion of the wrap still connected to the source of wrap will be captured between the wedge member 610 of the finger 38*b* and the first cam 500*b*. The vehicle 38*b* will then move a position between the first cam 500*b* and the second cam 504*b* almost at the end of the first cam 500*b* and the second cam 504*b*. The arm 34*b* will then rise as discussed above, the product 12 can be removed from the turntable 16 and a new product is placed on the turntable 16. The arm 34*b* will then lower again and the turntable 16 will begin to rotate to wrap the new product.

After at least a couple of turns of the turntable, the vehicle 38*b* will move the end 90*b* of the horizontal section 78*b* of the arm 34*b* and from out of a position between the first cam 500*b* and the second cam 504*b*, thereby dropping the end of the wrap onto the product.

Figure 23:
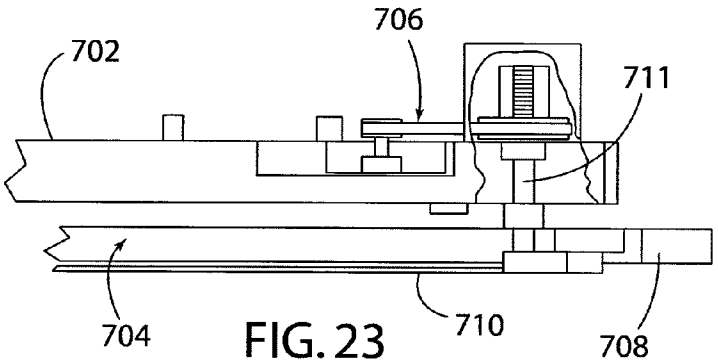
FIG. 23 is a fragmentary front view of a stationary arm and a rotating arm of the stretch wrap machine of the present invention.
Figure 22:
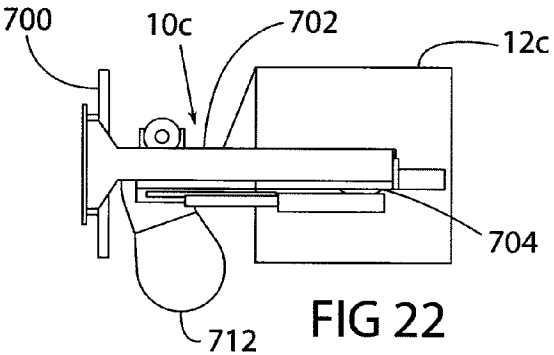
FIG. 22 is a top view of the fourth embodiment of the stretch wrap machine of the present invention.
Figure 21:
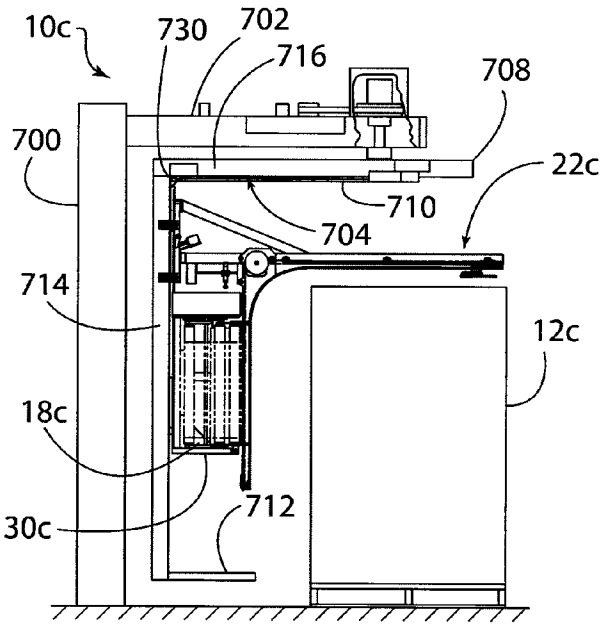
FIG. 21 is a front view of a fourth embodiment of the stretch wrap machine of the present invention.

The reference numeral 10*c* (FIGS. 21-23) generally designates another embodiment of the present invention, having a fourth embodiment for the stretch wrap machine. Since stretch wrap machine 10*c* is similar to the previously described stretch wrap machine 10, similar parts appearing in FIGS. 1-14 and FIGS. 21-23, respectively, are represented by the same, corresponding reference number, except for the suffix "c" in the numerals of the latter. The stretch wrap machine 10*c* of the fourth embodiment of the present invention does not include a turntable. The stretch wrap machine 10*c* of the fourth embodiment of the present invention includes a rotating 704 that has the source 18*c* of stretch wrap 20*c* thereon, with the arm 704 rotating about the product 12*c* to wrap the product 12*c*.

In the illustrated embodiment, the stretch wrap machine 10*c* includes a vertical column 700 fixed to a floor and a cantilever arm 702 extending horizontally from the vertical column 700. The rotating arm 704 is rotatably connected to an end of the cantilever arm 702 by a pivot pin 711. A motor and gear assembly 706 on the cantilever arm 702 rotates the pivot pit 711 to thereby rotating the rotating arm 704. The rotating arm 704 includes a vertical section 714 having a clearance member 712 at a bottom thereof and a horizontal section 716, with the carriage 30*c* configured to move vertically on the vertical section 714 to wrap the product 12*c* as the rotating arm 704 rotates about the product 12*c*. The vertical column 700, the cantilever arm 702, the pivot pin 711, the motor and gear assembly 706, the rotating arm 704, the clearance member 712 and the movement of the carriage 30*c* on the vertical section 714 of the rotating aim 704 are well known to those skilled in the art.

The illustrated fourth embodiment of the stretch wrap machine 10*c* further includes the wrapping assembly 22*c* on the vertical section 714 of the rotating arm 704. The wrapping assembly 22*c* can comprise any one of the wrapping assemblies described above in the first, second and third embodiments of the stretch wrap machine described above. In the illustrated embodiment, an end of the horizontal section 716 includes a motor 708 having a linking member 710 connected thereto. The linking member 710 extends from the motor 708, around a wheel 730 at a junction between the horizontal section 716 and the vertical section 714 of the rotating arm 704, and connects to the carriage 30*c*. The motor 708 is configured to wind and unwind the linking member 710 to move the carriage 30*c* vertically on the vertical section 714 of the rotating arm 704. As described above, the wrapping assembly 22*c* is configured to ride on the carriage 30*c*.

The reference number 1010 (FIGS. 24-27, 32 and 33) generally designates a fifth embodiment of the stretch wrap machine embodying the present invention. In the illustrated example, the stretch wrap machine 1010 is for wrapping a product 1012 and comprises a base 1014, a turntable 1016 on the base 1014 for rotating the product 1012, a source 1018 of stretch wrap 1020 connected to the base 1014 and a wrapping apparatus 1022. The wrapping apparatus 1022 is configured to cut the stretch wrap 1020 at a position above the product 1012 after the product 1012 has been wrapped and/or hold a portion 1024 of the stretch wrap 1020 at a position above the product 1012 as the turntable 1016 begins rotating the product 1012.

In the illustrated example, the base 1014 includes the turntable 1016 for rotating the product 1012 and a column 1026 supporting the source 1018 of stretch wrap 1020 and the wrapping apparatus 1022. The turntable 1016 is configured to have the product 1012 placed thereon. While the turntable 1016 is illustrated as being circular, it is contemplated that any shape could be employed. The turntable 1016 is connected to a motor (not shown) that is activated to rotate the turntable 1016. It is contemplated that the turntable 1016 can be connected to the motor using any means. The motor is operatively connected to a control system (not shown) that rotates the turntable 16 during the wrapping process. The base 1014 and turntable 1016 are well known to those skilled in the art.

The illustrated column 1026 extends upwardly from the base 1014 and has the source 1018 of stretch wrap 1020 connected thereto. The source 1018 of stretch wrap 1020 is located on a carriage 1030 that moves the source 1018 of stretch wrap 1020 vertically between a position above a top and a bottom of the product 1012 in order to wrap the product 1012. Preferably, the source 1018 of stretch wrap 1020 includes a roll of stretch wrap 1020 placed on the carriage 1030. The carriage 1030 preferably prestretches the stretch wrap 1020 in order to lengthen the stretch wrap 1020 in a manner known to those skilled in the art. However, it is contemplated that the carriage 1030 does not prestretch the stretch wrap 1020. The carriage 1030 can be moved vertically on the column 1026 by many methods, all of which are well known to those skilled in the art. The carriage 1030 also includes a source of power connected thereto in a manner well known to those skilled in the art. The carriage and its manner of loading and moving on the column are conventional and well known to those skilled in the art.

In the illustrated example, the wrapping apparatus 1022 uses the stretch wrap 1020 from the source 1018 of stretch wrap 1020 to wrap the product 1012. The wrapping apparatus 1022 includes an arm 1034 extending from the column 1026 that moves vertically in a line substantially parallel to the movement of the carriage 1030. The arm 1034 includes a substantially horizontal member 1036 that moves within a substantially vertical slot 1038 in the column 1026. The arm 1034 includes an inverted L-shaped member 1040 extending from the horizontal member 1036, a pivot member 1042 extending downwardly from the horizontal member 1036 and gripping plates 1044 extending downwardly from an end of the horizontal member 1036. In the illustrated example, the arm 1034 includes a support beam 1046 connected to the top of the horizontal member 1036 for supporting the horizontal member 1036. The support beam 1046 also is configured to move within the slot 1038 in the column 1026. However, it is contemplated that the wrapping apparatus 1022 could include additional support beams or no support beams for the horizontal member 1036.

Figure 26:
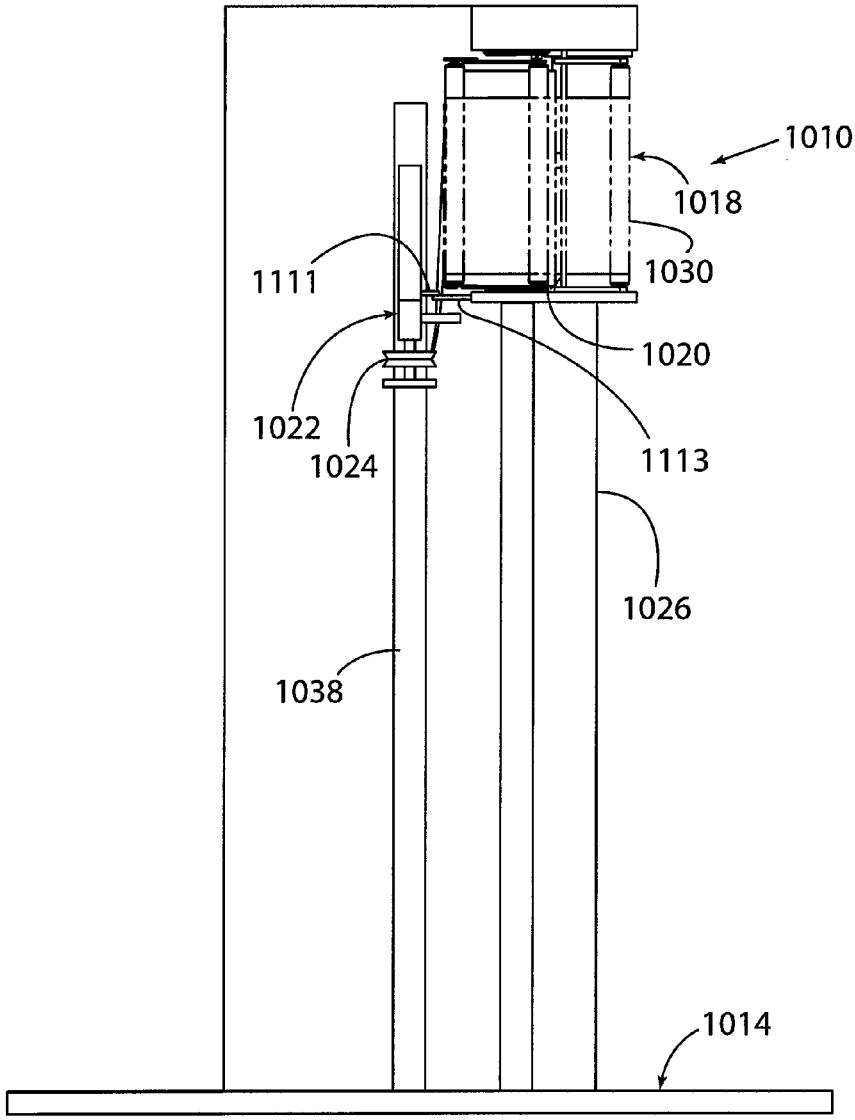
FIG. 26 is front view of the fifth embodiment of the stretch wrap machine of the present invention in the loading position and with no product on the stretch wrap machine.

As illustrated in FIG. 26, the wrapping apparatus 1022 includes a projection 1111 configured to ride on a mating projection 1113 extending from the carriage 1030. Therefore, when the carriage 1030 raises, the projection 1113 of the carriage 1030 will abut against the projection 1111 of the wrapping apparatus 1022 to raise the wrapping apparatus 1022. Furthermore, when the carriage 1030 lowers, the wrapping apparatus 1022 will also lower until the pivot member 1042 abuts against a top of the product 1012 as discussed in more detail below. The wrapping apparatus 1022 can include elements to prevent binding of the wrapping apparatus 1022 as it moves vertically as are well known to those skilled in the art. It is contemplated that the wrapping apparatus 1022 could include its own motor to move the wrapping apparatus 1022 vertically instead of having the wrapping apparatus 1022 ride on the carriage 1030. In the illustrated embodiment, the arm

1034 is located to the left of the carriage 1030. However, it is contemplated that the arm 1034 could be located to the right of the carriage 1030 and/or could be supported by its own column.

The illustrated arm 1034 uses the pivot member 1042 to support the arm 1034 on the product 1012. Furthermore, the illustrated arm 1034 uses the inverted L-shaped member 1040 and the gripping plates 1044 and to hold or abut the stretch wrap 1020. The inverted L-shaped member 1040 includes a vertical portion 1048 and a horizontal portion 1050. The horizontal portion 1050 extends substantially perpendicular to the vertical portion 1048 and the horizontal member 1036 of the arm 1034. The horizontal portion 1050 extends in a direction towards the carriage 1030. The pivot member 1042 includes a post 1052 extending downwardly from the horizontal member 1036 of the arm 1034 and a spinning plate 1054 at a bottom of the post 1052. The spinning plate 1054 is configured to spin freely relative to the post 1052. The gripping plates 1044 comprise an upper plate 1056 and a lower plate 1058.

Figure 29:
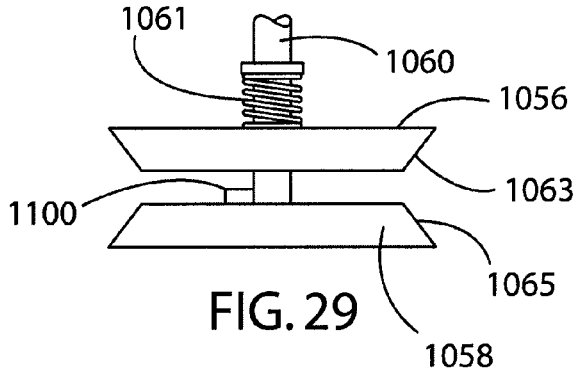
FIG. 29 is a side view of gripping plates of the fifth embodiment of the stretch wrap machine of the present invention.
Figure 30:
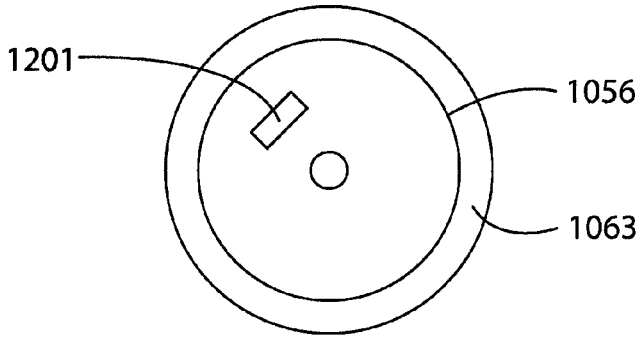
FIG. 30 is a bottom view of a top plate of the gripping plates of the fifth embodiment of the stretch wrap machine of the present invention.
Figure 31:
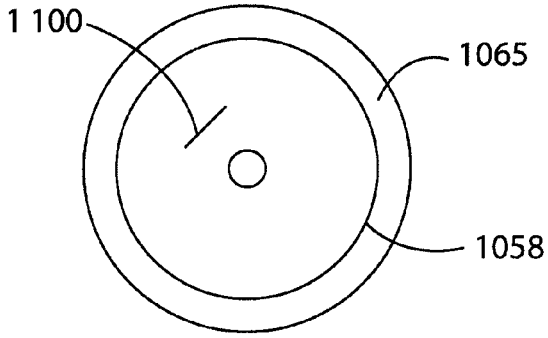
FIG. 31 is a top view of a bottom plate of the gripping plates of the fifth embodiment of the stretch wrap machine of the present invention.

As illustrated in FIGS. 29-31, the upper plate 1056 and the lower plate 1058 are connected to a rod 1060 extending downwardly from the end of the horizontal member 1036 of the arm 1034. The lower plate 1058 is fixed in position at the end of the rod 1060 and the upper plate 1056 is biased towards the lower plate 1058 by a spring 1061. The upper plate 1056 includes a downwardly and inwardly tapered outer surface 1063 and the lower plate 1058 includes an upwardly and inwardly tapered outer surface 1065. The outer surfaces 1063 and 1065 assist in inserting a rope of the stretch wrap 1020 between the upper plate 1056 and the lower plate 1058 as described in more detail below. As illustrated in FIGS. 29 and 31, the lower plate 1058 includes a cutting blade 1100 extending towards the upper plate 1056. The cutting blade 1100 is configured to be inserted into a slot 1201 in a lower face of the upper plate 1056 and the upper plate 1056 and the lower plate 1058 come together under the force of the spring 1061.

Figure 24:
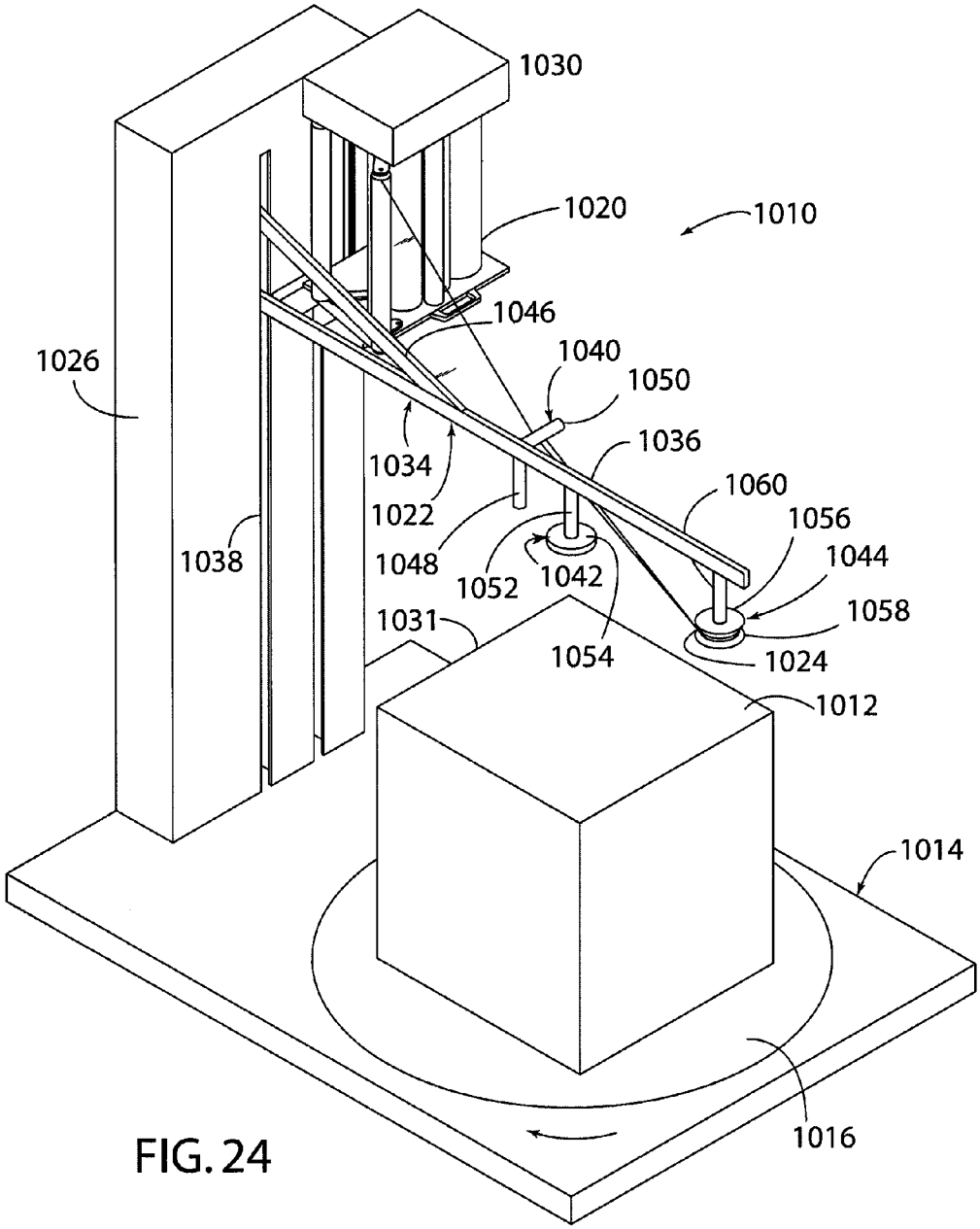
FIG. 24 is a perspective view of a fifth embodiment of the stretch wrap machine of the present invention in a loading position.
Figure 25:
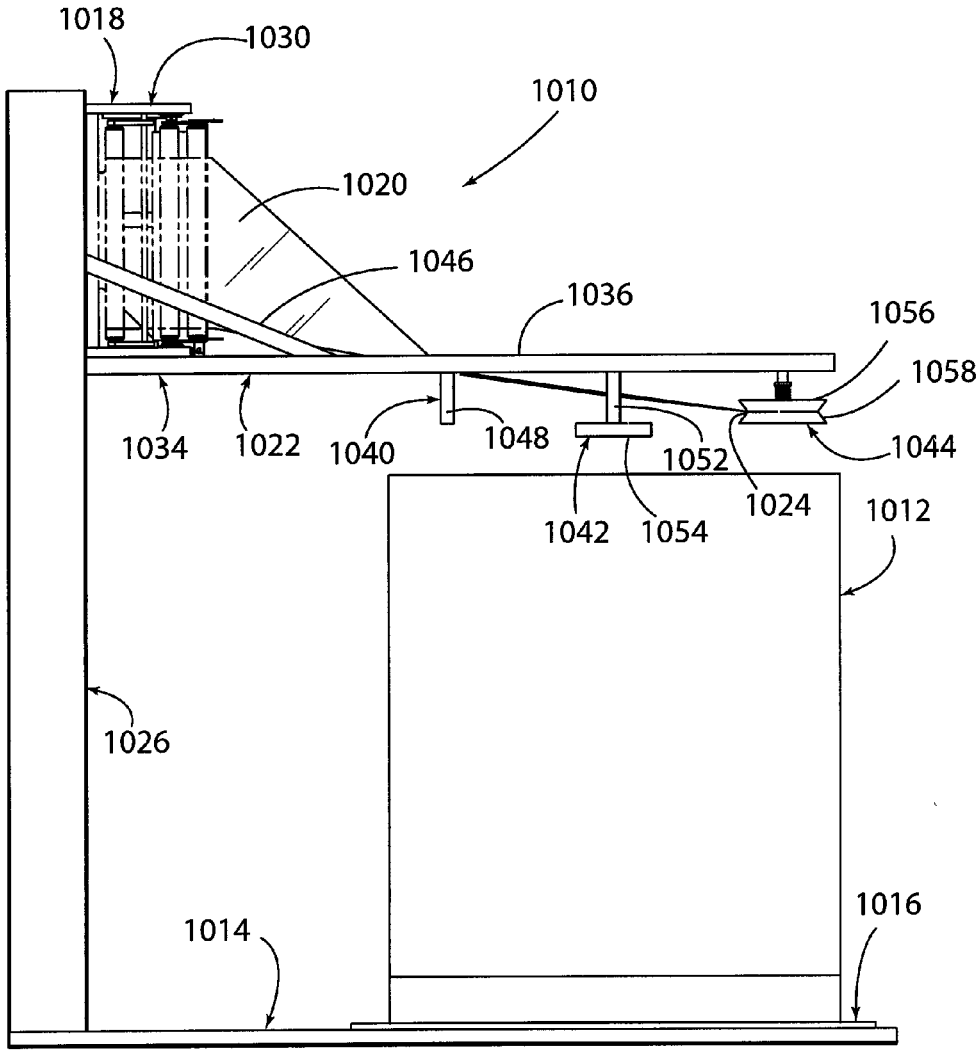
FIG. 25 is a front view of the fifth embodiment of the stretch wrap machine of the present invention in the loading position.

FIGS. 24-26 illustrate the stretch wrap machine 1010 in a start position. In the start position, a product 1012 that has not been wrapped yet is placed on the turntable 1016. Furthermore, the arm 1034 of the wrapping apparatus 1022 is located above the product 1012 to allow the product 1012 to be placed on the turntable 1016 without interference with the wrapping assembly 1022. As illustrated in FIGS. 24-26, the stretch wrap 1020 extends from the source 1018 of stretch wrap 1020, under the horizontal portion 1050 of the inverted L-shaped member 1040 and between the gripping plates 1044. The gripping plates 1044 hold the portion 1024 of the stretch wrap 1020 comprising a leading end 1024' of the stretch wrap 1020 between the upper plate 1056 and the lower plate 1058.

Figure 27:
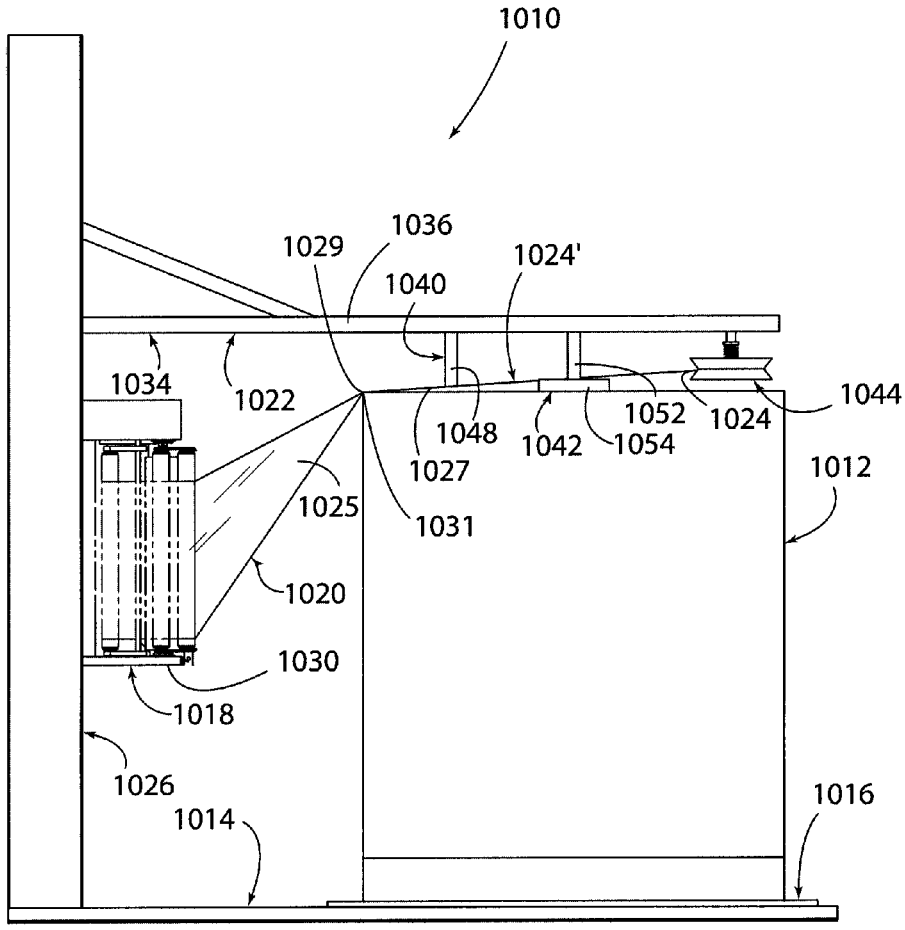
FIG. 27 is front view of the fifth embodiment of the stretch wrap machine of the present invention in a start position.

Thereafter, the wrapping apparatus 1022 lowers as illustrated in FIG. 27 to position the stretch wrap machine 1010 in a start position for beginning to wrap the product 1012. In the start position, the spinning plate 1054 of the pivot member 1042 rests on a top of the product 1012 to support the arm 1034 and to hold the product in position 1012. Preferably, the center of rotation of the spinning plate 1054 is co-linear with the center of rotation of the turntable 1016. Furthermore, the carriage 1030 is lowered below the arm 1034 and a bottom of the source of stretch wrap is lowered below a top of the product. Therefore, the stretch wrap 1020 forms into a first triangular part 1025 and a second rope part 1027, with the stretch wrap 1020 forming a rope transition point 1029 between the first triangular part 1025 and the second rope part 1027 on a top corner 1031 of the product 1012.

Figure 28:
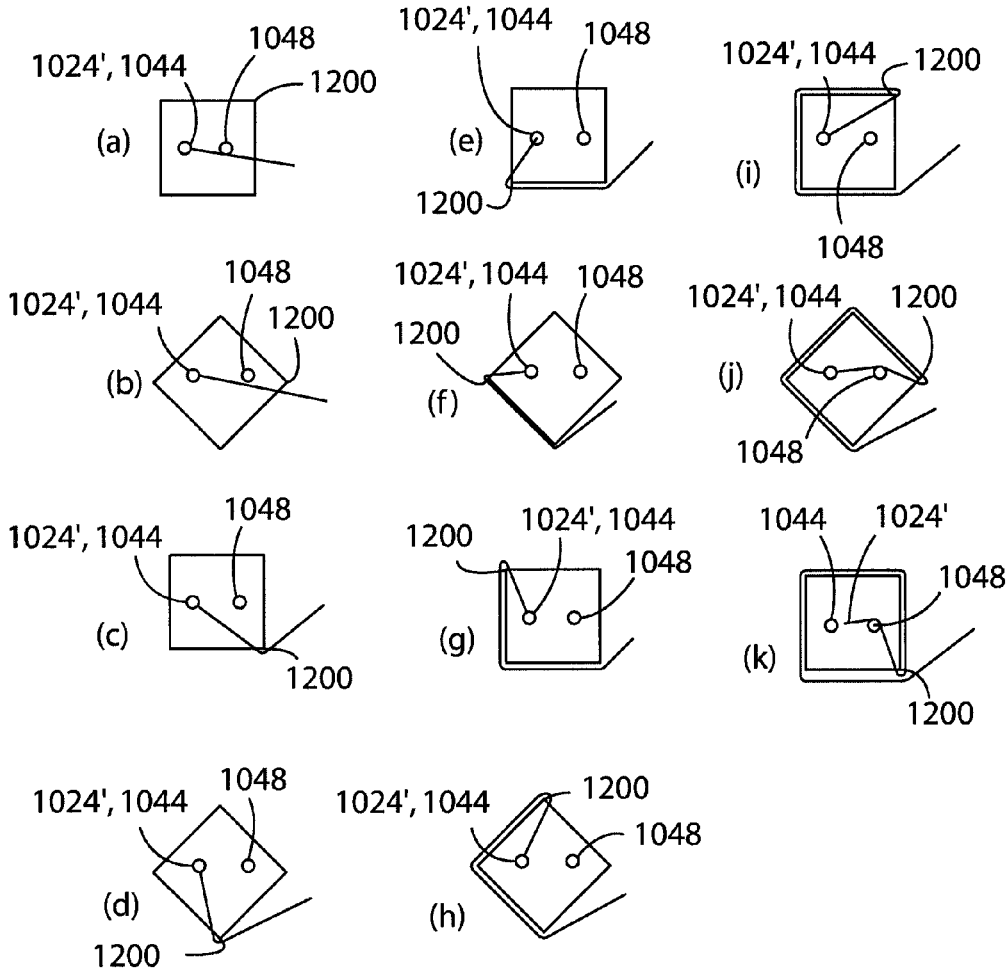
FIG. 28 is top schematic view of the fifth embodiment of the stretch wrap machine of the present invention during rotation of a product through 450° of rotation.

The stretch wrap machine 1010 then begins to wrap the product 1012 by rotating the turntable 1016 as illustrated in FIG. 28. FIG. 28 illustrated the product 1012 during 450° of rotation of the product 1012 on the turntable 1016 at the following angles of rotation: (a) 0°, (b) 45°, (c) 90°, (d) 135°, (e) 180°, (f) 225°, (g) 270°, (h) 315°, (i) 360°, (j) 405° and (k) 450°. FIG. 28 also illustrates the leading end 1024' of the stretch wrap 1020, the gripping plates 1044, the vertical portion 1048 of the inverted L-shaped member 1040 and the stretch wrap 1020 as it leads back to the source 1018 of stretch wrap 1020.

At first, the rope transition point 1029 will move along the top corner 1031 of the product 1012. However, when the rope transition point 1029 meets a corner 1200 of the product 1012, the rope transition point 1029 will catch on the corner 1200 and move therewith as illustrated in FIG. 28(*c*), thereby beginning to wrap the product 1012 with the stretch wrap 1020. The source 1018 of stretch wrap 1020 will then begin to move vertically to wrap the sides of the product 1012. As illustrated in FIG. 28(*j*), after the product 1012 has been wrapped at least one time, the stretch wrap 1020 extending between the gripping plates 1044 and the corner 1200 will abut the vertical portion 1048 of the inverted L-shaped member 1040. After further rotation as illustrated in FIG. 28(*k*), the stretch wrap 1020 will begin to pull against the vertical portion 1048 of the inverted L-shaped member 1040, thereby pulling the leading end 1024' of the stretch wrap 1020 out of the gripping plates 1044 and dropping the leading end 1024' of the stretch wrap 1020 onto the top of the product 1012.

Figure 32:
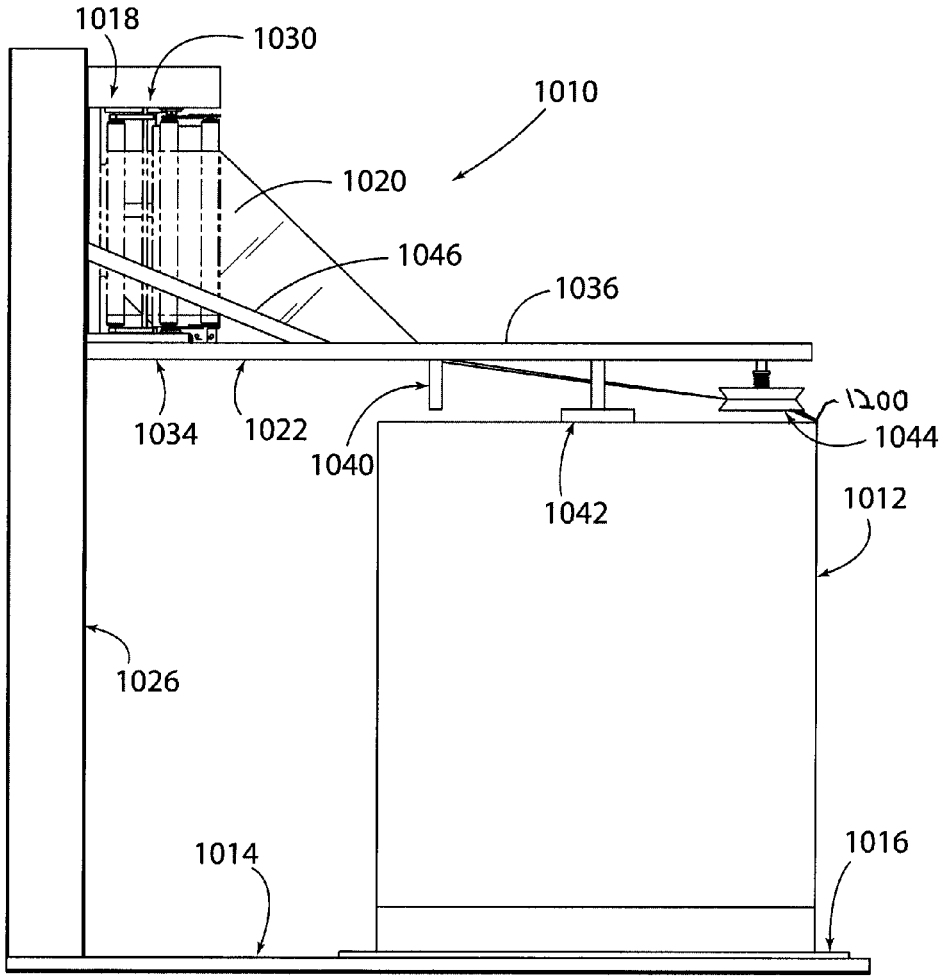
FIG. 32 is front view of the fifth embodiment of the stretch wrap machine of the present invention in a first proximate to end position.
Figure 33:
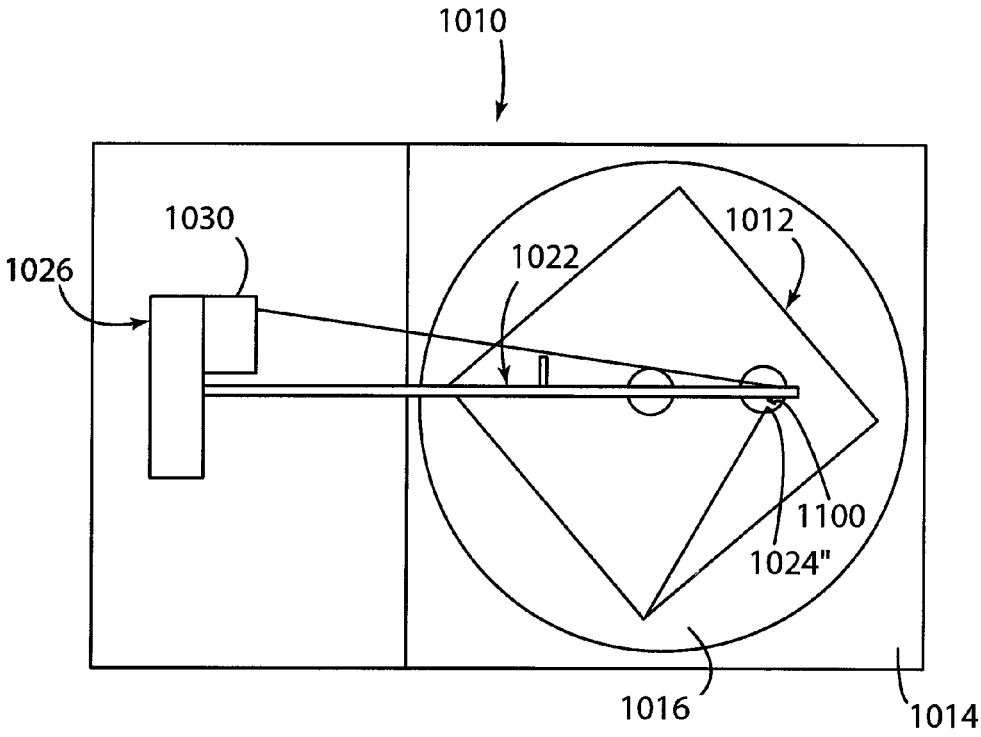
FIG. 33 is top view of the fifth embodiment of the stretch wrap machine of the present invention in a second proximate to end position.

To finish wrapping the product 1012 in the illustrated example, the carriage 1030 will move upward above a top of the arm 1034 as illustrated in FIG. 32. As the carriage 1030 moves above the arm 1034, the stretch wrap 1020 will be collected under the horizontal portion 1050 of the inverted L-shaped member 1040, thereby forming the stretch wrap 1020 into a rope between a bottom of the horizontal portion 1050 of the inverted L-shaped member 1040 and the corner 1200 as illustrated in FIG. 32. The turntable 1016 will continue to rotate and the rope will be inserted between the gripping plates 1044. As the turntable 1016 continues to rotate, the stretch wrap 1020 between the gripping plates 1044 and the corner 1200 will abut against the cutting blade 1100 as illustrated in FIG. 33, thereby cutting the stretch wrap 1020 and forming a trailing end 1024" of the stretch wrap 1020 and a second leading end 1024' of the stretch wrap (i.e., a leading end 1024' for the stretch wrap 1020 for a subsequent product to be wrapped). Moreover, as the turntable 1016 continues to rotate further, the trailing end 1024" will be pulled out of the gripping plates 1044, thereby dropping the trailing end 1024" on top of the product 1012. The product 1012 is therefore fully wrapped and can be removed from the turntable 1016 and the wrapping machine 1010 is positioned again in the initial position of FIG. 24. As used herein, the portion 1024 of the stretch wrap 1020 can comprise the leading end 1024', the trailing end 1024" or a combination of both the leading end 1024' and the trailing end 1024".

The reference numeral 1010*a* (FIGS. 34-36) generally designates another embodiment of the present invention, having a sixth embodiment for the stretch wrap machine. Since stretch wrap machine 1010*a* is similar to the previously described stretch wrap machine 1010, similar parts appearing in FIGS. 24-33 and FIGS. 34-36, respectively, are represented by the same, corresponding reference number, except for the suffix "a" in the numerals of the latter. The stretch wrap machine 1010*a* of the sixth embodiment of the present invention does not include a turntable. The stretch wrap machine 1010*a* of the second embodiment of the present invention includes a rotating arm 1704 that has the source 1018*a* of stretch wrap 1020*a* thereon, with the arm 1704 rotating about the product 1012*a* to wrap the product 1012*a*.

In the illustrated embodiment, the stretch wrap machine 1010*a* includes a vertical column 1700 fixed to a floor and a cantilever arm 1702 extending horizontally from the vertical column 1700. The rotating arm 1704 is rotatably connected to an end of the cantilever arm 1702 by a pivot pin 1711. A motor and gear assembly 1706 on the cantilever arm 1702 rotates the pivot pit 1711 to thereby rotate the rotating arm 1704. The rotating arm 1704 includes a vertical section 1714 having a clearance member 1712 at a bottom thereof and a horizontal section 1716, with the carriage 1030*a* configured to move vertically on the vertical section 1714 to wrap the product 1012*c* as the rotating arm 1704 rotates about the product 1012*c*. The vertical column 1700, the cantilever arm 1702, the pivot pin 1711, the motor and gear assembly 1706, the rotating arm 1704, the clearance member 1712 and the movement of the carriage 1030*a* on the vertical section 1714 of the rotating arm 1704 are well known to those skilled in the art.

The illustrated sixth embodiment of the stretch wrap machine 1010*a* further includes the wrapping apparatus 1022*a* on the vertical section 1714 of the rotating arm 1704. The wrapping apparatus 1022*a* comprises the wrapping assembly described above. In the illustrated embodiment, an end of the horizontal section 1716 includes a motor 1708 having a linking member 1710 connected thereto. The linking member 1710 extends from the motor 1708, around a wheel 1730 at a junction between the horizontal section 1716 and the vertical section 1714 of the rotating arm 1704, and connects to the carriage 1030*a*. The motor 1708 is configured to wind and unwind the linking member 1710 to move the carriage 1030*a* vertically on the vertical section 1714 of the rotating arm 1704. As described above, the wrapping apparatus 1022*a* is configured to ride on the carriage 1030*a*.

The reference numeral 2010 (FIGS. 37-45) generally designates another embodiment of the present invention, having a seventh embodiment for the stretch wrap machine. Since stretch wrap machine 2010 is similar to the previously described stretch wrap machine 1010, similar parts appearing in FIGS. 24-33 and FIGS. 37-45, respectively, are represented by the same, corresponding reference number, except that numerals of the latter are in the two thousands instead on the one thousands of the former. In the illustrated example, the stretch wrap machine 2010 is for wrapping a product and comprises a base, a turntable on the base for rotating the product, a source of stretch wrap connected to the base and a wrapping apparatus 2022. The wrapping apparatus 2022 is configured to cut the stretch wrap at a position above the product after the product has been wrapped and/or hold a portion of the stretch wrap at a position above the product as the turntable begins rotating the product in the same manner as in the fifth embodiment of the stretch wrap machine 1010 described above. The seventh embodiment of stretch wrap machine 2010 includes a different wrapping apparatus 2022 than the wrapping apparatus 1022 of the fifth embodiment of the stretch wrap machine 1010.

In the illustrated example, the wrapping apparatus 2022 uses the stretch wrap from the source of stretch wrap to wrap the product. The wrapping apparatus 2022 includes an arm 2034 extending from the column that moves vertically in a line substantially parallel to the movement of the carriage. The arm 2034 includes a substantially horizontal member 2036 that moves within a substantially vertical slot in the column. Although not shown, the arm 2034 could include an inverted L-shaped member extending from the horizontal member 2036 and a pivot member extending downwardly from the horizontal member 2036, similar to the inverted L-shaped member 1040 and the pivot member 1042 of the fifth embodiment of the stretch wrap machine 1010 as described above. The arm 2034 also includes the wrapping apparatus 2022 extending downwardly from an end of the horizontal member 2036. In the illustrated example, the arm 2034 includes a support beam 2046 connected to the top of the horizontal member 2036 for supporting the horizontal member 2036. The support beam 2046 also is configured to move within the slot in the column. However, it is contemplated that the wrapping apparatus 2022 could include additional support beams or no support beams for the horizontal member 2036.

The illustrated wrapping apparatus 2022 can include a projection configured to ride on a mating projection extending from the carriage as discussed above in regard to the fifth embodiment of the stretch wrap machine 1010. The wrapping apparatus 2022 can include elements to prevent binding of the wrapping apparatus 2022 as it moves vertically as are well known to those skilled in the art. It is contemplated that the wrapping apparatus 2022 could include its own motor to move the wrapping apparatus 2022 vertically instead of having the wrapping apparatus 2022 ride on the carriage. The arm 2034 can be located to the left of the carriage or to the right of the carriage and/or could be supported by its own column. The illustrated arm 2034 can use a pivot member to support the arm 2034 on the product or the arm 2034 could have its own stopping mechanism interacting with the column for stopping vertical movement of the arm 2034. Furthermore, the arm 2034 uses the wrapping apparatus 2022 and to hold or abut the stretch wrap.

As illustrated in FIGS. 37-45, the wrapping apparatus 2022 includes a static collecting portion 2500 and a dynamic wrap holding and cutting portion 2502. The static collection portion 2500 comprises a support bracket 2504, a pair of vertically positioned guide pins 2506 connected to the support bracket 2504 and a bottom ramp member 2508. The support bracket 2504 includes a bottom plate 2510 connected to a top of the horizontal member 2036 of the arm 2034 adjacent an end thereof. The support bracket 2504 also includes a vertical plate 2512 extending upward from the bottom plate 2510 and a side support plate 2514 extending from a top of the vertical plate 2512. The side support plate 2514 extends to a position to a side of the arm 2034. The pair of vertically positioned guide pins 2506 are connected in a parallel manner to a bottom of the side support plate 2514. The bottom ramp member 2508 is connected to the bottom of the pair of vertically positioned guide pins 2506. The bottom ramp member 2508 includes a top surface 2516 and a ramp surface 2518 extending downwardly from one edge of the top surface 2516. The ramp surface 2518 is illustrated as being positioned below the arm 2034.

In the illustrated example, the dynamic wrap holding and cutting portion 2502 of the wrapping apparatus 2022 holds the wrap during certain periods of the wrapping process and cuts the wrap during the wrapping process. The dynamic wrap holding and cutting portion 2502 includes an actuator 2517 for actuating the dynamic wrap holding and cutting portion 2502, a sliding block 2519 interacting with the actuator 2517, a plunger 2520 for holding the wrap and a blade 2522 for cutting the wrap.

The illustrated actuator 2517 includes a first end 2524 connected to the arm 2034 by a clevis bracket 2526 and a second end 2528 interconnected to the sliding block 2519. The clevis bracket 2526 is substantially L-shaped and includes a horizontal portion 2530 connected to top of the arm 2034 and extending outwardly therefrom in the same direction that the side support plate 2514 of the support bracket 2504 extends from the arm 2034 and a vertical portion 2532. The vertical portion 2532 is pivotally connected to the first end 2524 of the actuator 2517. The actuator 2517 includes a linearly extending component 2534 configured to move in a linear direction along line 2536 at the second end 2528 of the actuator 2517. The linearly extending component 2534 is connected to the sliding block 2519 via a linking assembly 2538. The actuator 2517 moves the sliding block 2519 by moving the linearly extending component 2534 along the line 2536 via the linking assembly 2538.

Figures 37, 38:
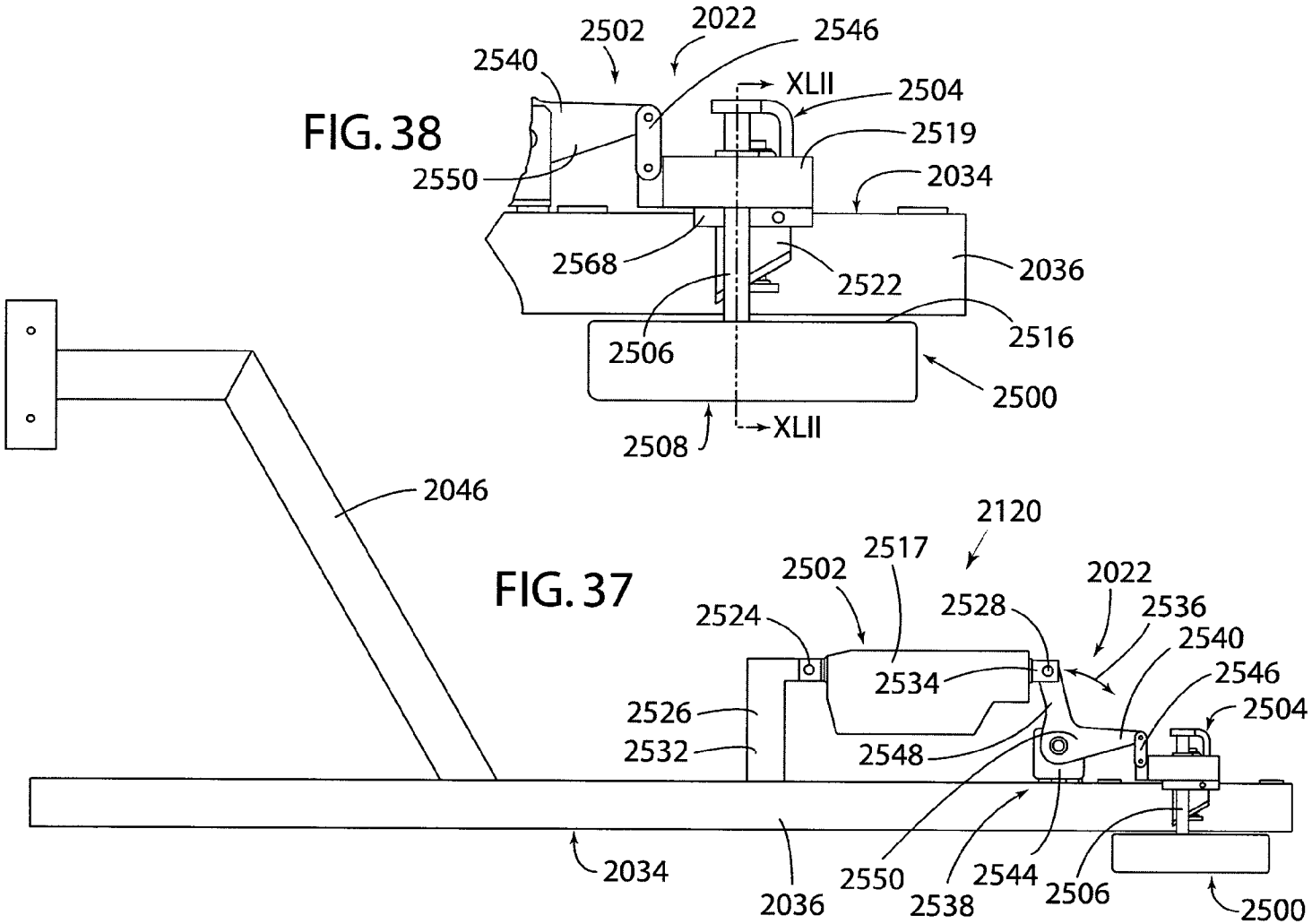
FIG. 37 is a front view of a wrapping apparatus of a seventh embodiment of the stretch wrap machine of the present invention.
FIG. 38 is an enlarged front view of an end of the wrapping apparatus of the seventh embodiment of the stretch wrap machine of the present invention.
Figure 39:
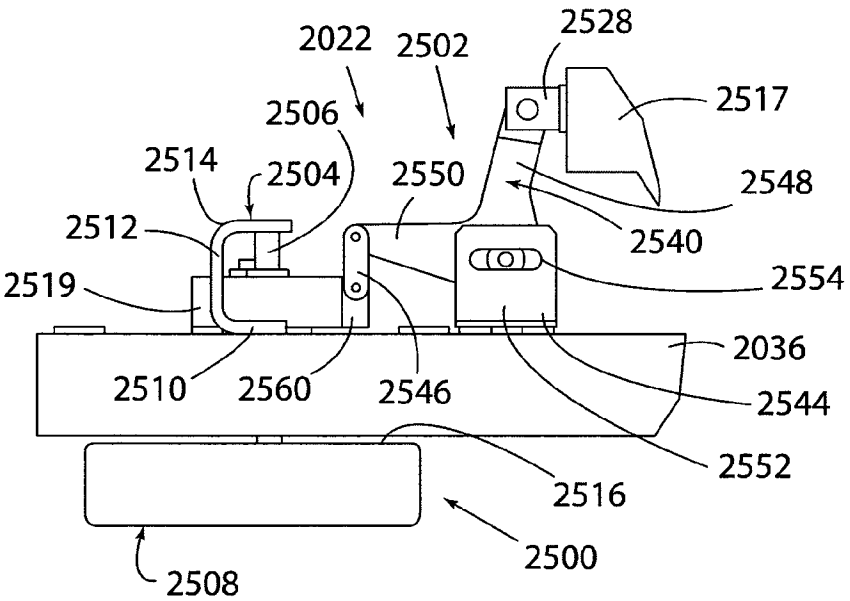
FIG. 39 is an enlarged rear view of the end of the wrapping apparatus of the seventh embodiment of the stretch wrap machine of the present invention.
Figure 40:
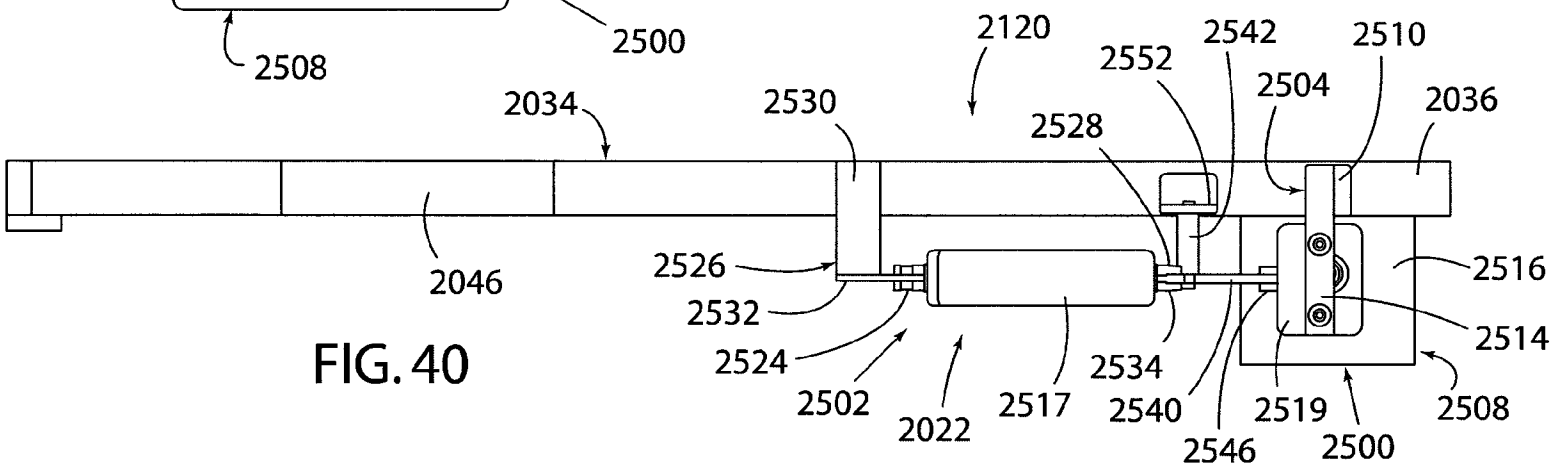
FIG. 40 is a top view of the wrapping apparatus of the seventh embodiment of the stretch wrap machine of the present invention.

In the illustrated embodiment, the linking assembly 2538 includes a substantially L-shaped lever 2540, a pivot shaft 2542, a pivot shaft bracket 2544 and at least one link 2546. The L-shaped lever 2540 includes a generally vertically positioned portion 2548 connected to the linearly extending component 2534 of the actuator 2517 and a generally horizontally positioned portion 2550. The pivot shaft 2542 includes a first end connected to the L-shaped lever 2540 at the intersection of the generally vertically positioned portion 2548 and the generally horizontally positioned portion 2550 and a second end connected to the pivot shaft bracket 2544. The pivot shaft bracket 2544 is connected to a top of the arm 2034 and includes a vertical plate 2552 having a slot 2554 therein. The second end of the pivot shaft 2542 is located in the slot 2554 and is configured to slide therein. As the linearly extending component 2534 of the actuator 2517 is extended out of the actuator 2517, the L-shaped lever 2540 is rotated in a clockwise direction as illustrated in FIG. 38, thereby forcing the L-shaped lever 2540 to pivot in a generally clockwise direction about the pivot shaft 2542 and forcing an end of the generally horizontally positioned portion 2550 of the L-shaped lever 2540 downward. The at least one link 2546 connects the end of the generally horizontally positioned portion 2550 of the L-shaped lever 2540 to the sliding block 2519.

Figure 42:
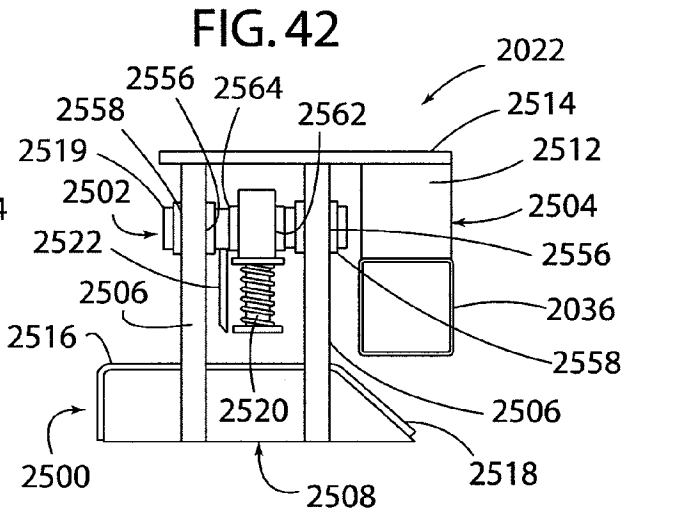
FIG. 42 is a cross-sectional view of the wrapping apparatus of the seventh embodiment of the stretch wrap machine of the present invention taken along the line XLII-XLII of FIG. 38.

The illustrated sliding block 2519 is configured to slide on the pair of vertically positioned guide pins 2506 of the static collecting portion 2500 of the wrapping apparatus 2022. The sliding block 2519 includes a pair of parallel openings 2556 for accepting the guide pins 2506 therein. As illustrated in FIG. 42, a bushing 2558 can surround the guide pins 2506 within the opening 2556 for allowing the sliding block 2519 to easily slide on the guide pins 2506. The sliding block 2519 includes a projection 2560 pivotally connected to the at least one link 2546, thereby connecting the sliding block 2519 to the actuator 2517. The sliding block 2519 includes an aperture 2562 having the plunger 2520 therein. The plunger 2520 is configured to slide within the aperture 2562. As illustrated in FIG. 42, a bushing 2564 can surround the plunger 2520 within the aperture 2562 for allowing the plunger 2520 to easily slide within the aperture 2562. A compression spring 2566 surrounds the plunger 2520 and biases the plunger 2520 in a downward direction through the aperture 2562. The blade 2522 is connected to the sliding block 2519 by a blade support block 2568 connected to a bottom of the sliding block 2519.

Figure 44:
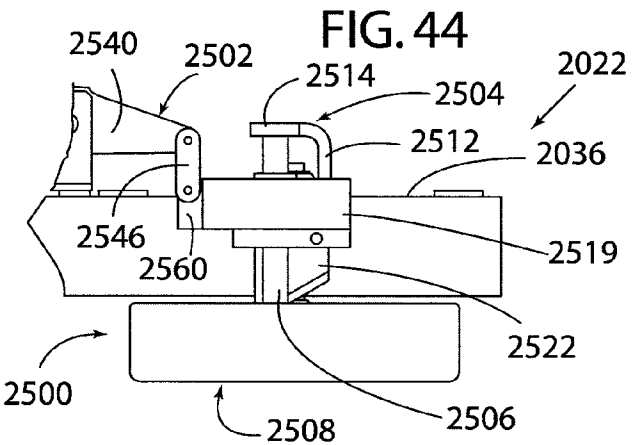
FIG. 44 is an enlarged view of the end of the wrapping apparatus of the seventh embodiment of the stretch wrap machine of the present invention in a capture position.
Figure 41:
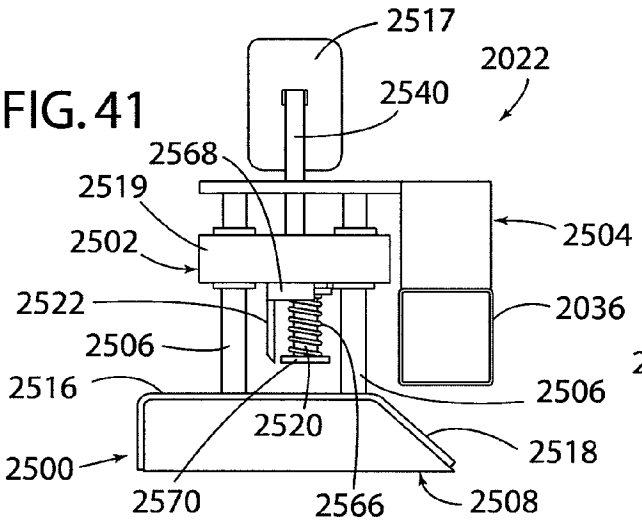
FIG. 41 is an end view of the wrapping apparatus of the seventh embodiment of the stretch wrap machine of the present invention.
Figure 45:
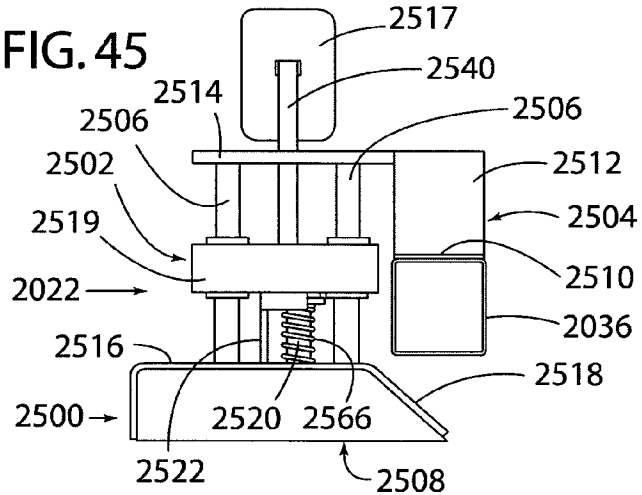
FIG. 45 is an end of the wrapping apparatus of the seventh embodiment of the stretch wrap machine of the present invention in the capture position.

The illustrated seventh embodiment of the stretch wrap machine 2010 operates in the same manner as the fifth embodiment of the stretch wrap machine. Therefore, in the start position, a product that has not been wrapped yet is placed on the turntable. Furthermore, the arm 2034 of the wrapping apparatus 2022 is located above the product to allow the product to be placed on the turntable without interference with the wrapping assembly. Similar to that illustrated in FIGS. 24-26, the stretch wrap extends from the source of stretch wrap (under the horizontal portion of the inverted L-shaped member if such a member is used) and an end of the stretch wrap is captured in the wrapping apparatus 2022 between an enlarged head 2570 at a bottom of the plunger 2520 of the dynamic wrap holding and cutting portion 2502 and the top surface 2516 of the bottom ramp member 2508 of the static collecting portion 2500. Such a capture position is illustrated in FIGS. 44 and 45. In the capture position, the linearly extending component 2534 of the actuator 2517 extends out of the actuator 2517, thereby rotating the L-shaped lever 2540 in a clockwise direction, forcing the L-shaped lever 2540 to pivot in a generally clockwise direction about the pivot shaft 2542, and forcing an end of the generally horizontally positioned portion 2550 of the L-shaped lever 2540 downward. The downward force of the end of the generally horizontally positioned portion 2550 of the L-shaped lever 2540 forces the at least one link 2548 downward, thereby moving the sliding block 2519 downward along the guide pins 2506. As the sliding block 2519 moves downward, the enlarged head 2570 at the bottom of the plunger 2520 of the dynamic wrap holding and cutting portion 2502 is moved towards the top surface 2516 of the bottom ramp member 2508 of the static collecting portion 2500, thereby capturing the end of the stretch wrap between the enlarged head 2570 at a bottom of the plunger 2520 and the top surface 2516 of the bottom ramp member 2508. The wrapping apparatus 2022 therefore holds the portion of the stretch wrap comprising a leading end of the stretch wrap between the plunger 2520 and the bottom ramp member 2508.

Thereafter, the wrapping apparatus 2022 lowers to position the stretch wrap machine in a start position for beginning to wrap the product. In the start position, a spinning plate of the pivot member, if one is used, rests on a top of the product to support the arm 2034 and to hold the product in position. Alternatively, the aim 2034 can be moved into position above the product and stopped in that position using a stop mechanism in the column. Furthermore, the carriage is lowered below the arm 2034 and a bottom of the source of stretch wrap is lowered below a top of the product. Therefore, the stretch wrap forms into a first triangular part and a second rope part, with the stretch wrap forming a rope transition point between the first triangular part and the second rope part on a top corner of the product, similar to that discussed above in regard to FIG. 27.

The stretch wrap machine 2010 then begins to wrap the product by rotating the turntable similar that that illustrated in FIG. 28. At first, the rope transition point will move along the top corner of the product. However, when the rope transition point meets a corner of the product, the rope transition point will catch on the corner and move therewith as illustrated in FIG. 28(*c*), thereby beginning to wrap the product with the stretch wrap. The source of stretch wrap will then begin to move vertically to wrap the sides of the product.

After the product has been wrapped at least one time, the wrapping apparatus 2022 will move to the open or release position. Such a release position is illustrated in FIGS. 37-43. In the release position, the linearly extending component 2534 of the actuator 2517 will move back into the actuator 2517, thereby rotating the L-shaped lever 2540 in an counter-clockwise direction, forcing the L-shaped lever 2540 to pivot in a generally counter-clockwise direction about the pivot shaft 2542, and forcing an end of the generally horizontally positioned portion 2550 of the L-shaped lever 2540 upward. The upward force of the end of the generally horizontally positioned portion 2550 of the L-shaped lever 2540 forces the at least one link 2546 upward, thereby moving the sliding block 2519 upward along the guide pins 2506. As the sliding block 2519 moves upward, the enlarged head 2570 at the bottom of the plunger 2520 of the dynamic wrap holding and cutting portion 2502 is moved away from the top surface 2516 of the bottom ramp member 2508 of the static collecting portion 2500, thereby releasing the end of the stretch wrap previously captured between the enlarged head 2570 at the bottom of the plunger 2520 and the top surface 2516 of the bottom ramp member 2508, thereby releasing the leading end of the stretch wrap from the wrapping apparatus 2022 and allowing the leading end of the stretch wrap to drop onto the top of the product.

Figure 43:
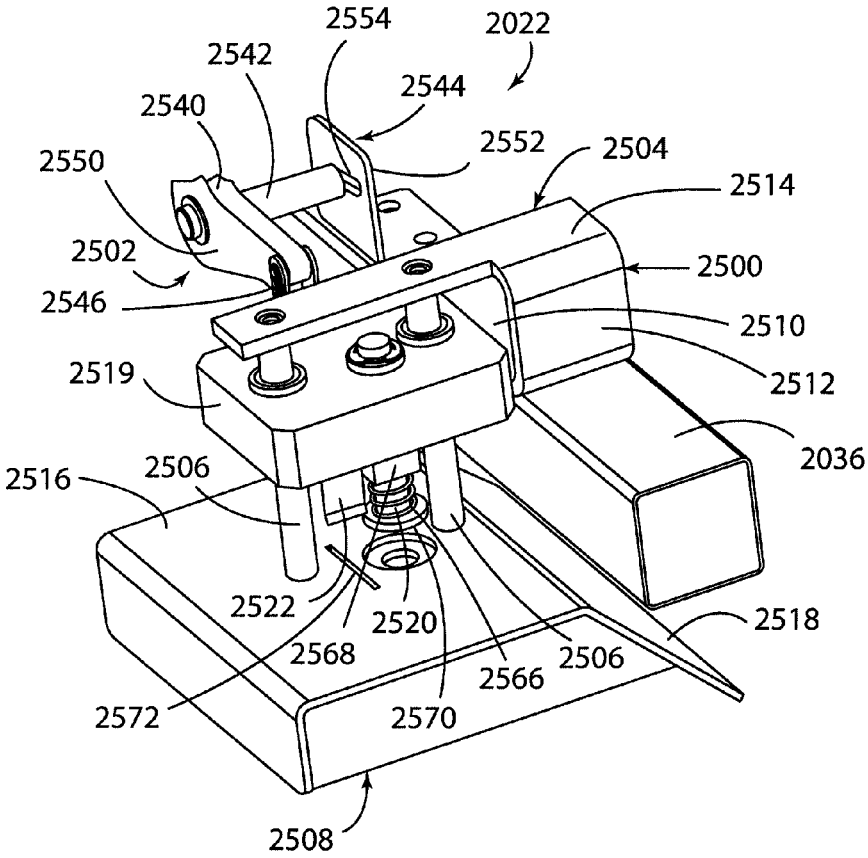
FIG. 43 is perspective view of the end of the wrapping apparatus of the seventh embodiment of the stretch wrap machine of the present invention.

To finish wrapping the product in the illustrated example, the carriage will move upward above a top of the arm 2034 similar to that as illustrated in FIG. 32. As the carriage moves above the arm 2034, the stretch wrap will be collected on top of the top surface 2516 of the bottom ramp member 2508 via the ramp surface 2518 of the bottom ramp member 2508. The turntable will continue to rotate and the stretch wrap, now in the form of a rope, will be inserted between the enlarged head 2570 at the bottom of the plunger 2520 and the top surface 2516 of the bottom ramp member 2508. As the turntable continues to rotate, the wrapping apparatus 2022 will once again move to the capture position, thereby capturing the stretch wrap between the enlarged head 2570 at the bottom of the plunger 2520 of the dynamic wrap holding and cutting portion 2502 and the top surface 2516 of the bottom ramp member 2508 of the static collecting portion 2500. Furthermore, the blade 2522 will move downward to cut the rope. As illustrated in FIG. 43, the top surface 2516 of the bottom ramp member 2508 includes a slit 2572 for accepting the blade 2522 therein to allow the blade 2522 to cut fully through the stretch wrap in the form of a rope, thereby cutting the stretch wrap and forming a trailing end of the stretch wrap and a second leading end of the stretch wrap (i.e., a leading end for the stretch wrap for a subsequent product to be wrapped). Moreover, as the turntable continues to rotate further, the trailing end will drop on top of the product. The product is therefore fully wrapped and can be removed from the turntable and the wrapping machine 2010 is positioned again in the initial position. As used herein, the portion of the stretch wrap can comprise the leading end, the trailing end or a combination of both the leading end and the trailing end. The actuator can be activated in manners well known to those skilled in the art (including a single button that will move the turntable, the carriage, the arm and the actuator).

Figure 36:
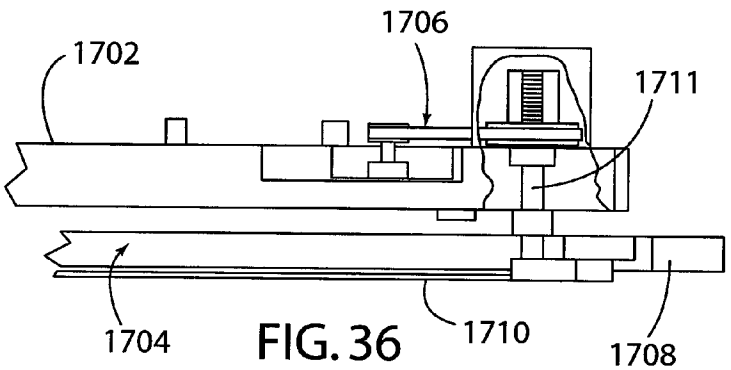
FIG. 36 is a fragmentary front view of a stationary arm and a rotating arm of the sixth embodiment of the stretch wrap machine of the present invention.
Figure 35:
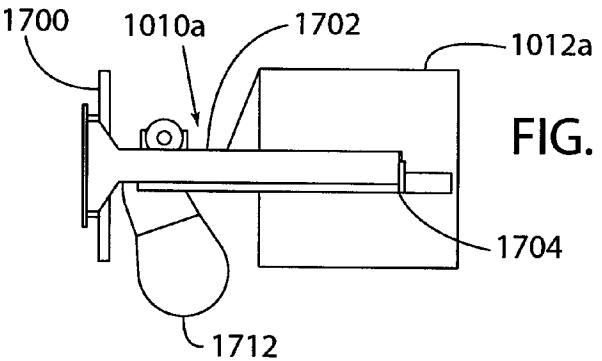
FIG. 35 is a top view of the sixth embodiment of the stretch wrap machine of the present invention.
Figure 34:
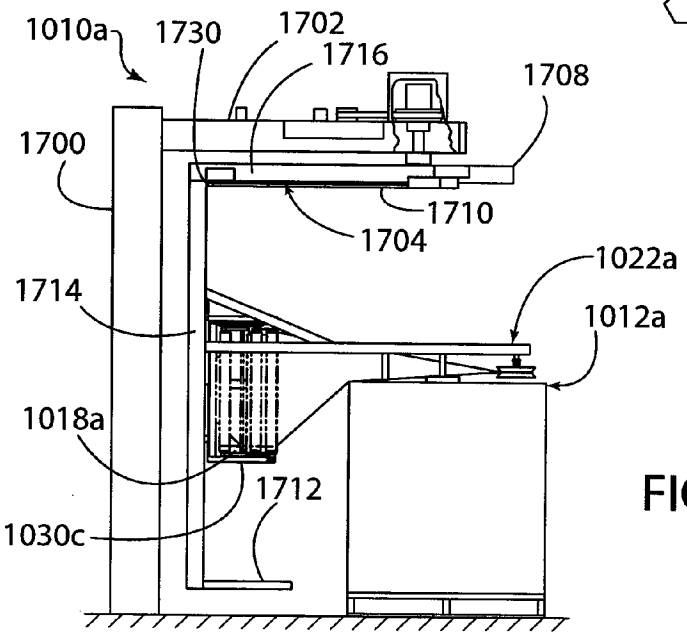
FIG. 34 is a front view of a sixth embodiment of the stretch wrap machine of the present invention.

It is further contemplated that the seventh embodiment of the embodiment for the stretch wrap machine 2010 can be used in a machine that does not include a turntable, such as that illustrated in FIGS. 34-36, with the wrapping apparatus 2022 being substituted for the wrapping apparatus 1022*a* of the sixth embodiment of the stretch wrapping machine 1010*a*.

It is to be understood that variations and modifications can be made on the aforementioned structure without departing from the concepts of the present invention. For example, prior art stretch wrap machines can easily be retrofitted by adding the wrapping assembly of the present invention to the prior art stretch wrap machines. Furthermore, it is contemplated that the turntable could be located on a conveyor or the rotating arm 704 could be configured to surround a product placed on a conveyor and moved thereon. Moreover, it is contemplated that the arm could include a member abutting a top of the product to prevent further downward movement of the arm instead of the pawl and associated elements. Further, it is to be understood that such concepts are intended to be covered by the following claims unless these claims by their language expressly state otherwise.

We claim:

1. A method of wrapping a product with wrapping material comprising:

holding a source of the wrapping material in a horizontally stationary position;

rotating the product about a vertical axis to wrap the product with the wrapping material;

positioning a leading end of the wrapping material above a top height of the product; and not maintaining the leading end of the wrapping material stationary relative to the product during initiation of a rotation cycle of the product relative to the source of the wrapping material.

2. The method of wrapping a product of claim 1, wherein:

positioning includes holding the leading end of the wrapping material during initiation of rotating the product.

3. The method of wrapping a product of claim 1, wherein:

positioning comprising holding the leading end of the wrapping material above the top height of the product with a holding apparatus; and further including moving the holding apparatus vertically directly above the product.

4. The method of claim 1, further including:

dropping the leading end of the wrapping material on top of the product during or after rotation.

5. A method of wrapping a product with wrapping material comprising:

rotating the product;

wrapping sides of the product with the wrapping material;

dropping an end of the wrapping material on top of the product during or after rotation; and not maintaining the end of the wrapping material stationary relative to the product during initiation of a rotation cycle of the product relative to the source of the wrapping material.

6. A method of wrapping a product with wrapping material comprising:

rotating the product relative to a source of the wrapping material;

wrapping the product with the wrapping material; and not maintaining a leading end of the wrapping material stationary relative to the product during initiation of a rotation cycle of the product relative to the source of the wrapping material.

7. The method of wrapping a product of claim 6, further including:

positioning the leading end of the wrapping material above a top height of the product;

holding a source of the wrapping material in a horizontally stationary position; and rotating the product about a vertical axis to wrap the product with the wrapping material.

8. The method of wrapping a product of claim 6, further including:

catching a corner of the product to begin wrapping the product.

9. The method of claim 6, further including:

dropping the leading end of the wrapping material on top of the product during or after rotation.

* * * * *